US006904157B2

(12) United States Patent
Shima

(10) Patent No.: US 6,904,157 B2
(45) Date of Patent: Jun. 7, 2005

(54) STRUCTURE AROUND A SPEAKER UNIT AND APPLIED ELECTRIC OR ELECTRONIC APPARATUS THEREOF

(75) Inventor: Yoshiharu Shima, Nagano (JP)

(73) Assignee: Shima System Co., Ltd., Nagano (JP)

( * ) Notice: Subject to any disclaimer, the term of this patent is extended or adjusted under 35 U.S.C. 154(b) by 0 days.

(21) Appl. No.: 09/917,717

(22) Filed: Jul. 31, 2001

(65) Prior Publication Data

US 2002/0018576 A1 Feb. 14, 2002

(30) Foreign Application Priority Data

Aug. 10, 2000 (JP) ..... 2000-241992
Aug. 10, 2000 (JP) ..... 2000-241993
Jan. 15, 2001 (JP) ..... 2001-006221

(51) Int. Cl.[7] ..... H04R 25/00
(52) U.S. Cl. ..... 381/388; 381/333; 381/386
(58) Field of Search ..... 381/301–302, 381/333–334, 346, 348, 354, 386, 396, 388–389; 181/199, 151

(56) References Cited

U.S. PATENT DOCUMENTS 3,135,349 A * 6/1964 Lahti ..... 381/341
3,290,450 A * 12/1966 Majoros ..... 381/182
3,384,719 A * 5/1968 Lanzara ..... 381/301
3,412,824 A * 11/1968 Armstrong ..... 181/151
3,430,728 A * 3/1969 Dunning ..... 381/348
3,870,834 A 3/1975 Yeaple
3,909,531 A * 9/1975 Plummer ..... 381/300
3,993,345 A * 11/1976 Croup ..... 296/37.16
4,038,499 A * 7/1977 Yeaple ..... 381/301
4,433,749 A * 2/1984 Watkins et al. ..... 181/151
4,475,620 A 10/1984 Carlsson
4,598,178 A * 7/1986 Rollins ..... 381/354
4,638,884 A 1/1987 Lee
5,123,133 A * 6/1992 Albert ..... 5/639
5,687,246 A * 11/1997 Lancon ..... 381/386
5,739,481 A 4/1998 Baumhauer, et al.
6,021,208 A 2/2000 Kin-Lung
6,258,438 B1 * 7/2001 Loveland et al. ..... 428/137
6,338,395 B1 * 1/2002 Setiabudi et al. ..... 181/151

FOREIGN PATENT DOCUMENTS

| | | |
|---|---|---|
| EP | 0 249 428 | 12/1987 |
| GB | 2 132 853 A | 7/1984 |
| JP | 02038040 | 2/1990 |
| WO | WO 86/02508 | 4/1986 |
| WO | WO 98/25438 | 6/1998 |

* cited by examiner

*Primary Examiner*—Curtis Kuntz
*Assistant Examiner*—P. Dabney
(74) *Attorney, Agent, or Firm*—Liniak, Berenato & White

(57) ABSTRACT

A compact lightweight speaker system without a resonance box that can reproduce the original sound with high fidelity. A speaker unit is located on a baffle board with a vibration absorbing member between a frame of the speaker unit and the baffle board. Furthermore, an acoustic resonance reflecting board of a vertical flat board type based on the operating principle of a passive radiator is formed by the baffle board and a flat board being similar to the baffle board. As a result, a compact smart design will be produced. It is applicable to an electric or electronic apparatus which produces sound.

20 Claims, 16 Drawing Sheets

STRUCTURE AROUND A SPEAKER UNIT AND APPLIED ELECTRIC OR ELECTRONIC APPARATUS THEREOF

FIELD OF THE INVENTION

The present invention relates to a compact, lightweight, and simple speaker system and/or a structure around a speaker that enables to reproduce sounds, including heavy low-pitched sounds, with high fidelity.

The present invention is also applicable to a minicomponent stereo, television, telephone, radio cassette recorder, built-in speaker for personal computer, 5.1 channel speaker, or the like.

Furthermore, the present invention is applicable to a speaker used inside a pillow or inside the pillow portion of an easy chair etc.

Moreover, the present invention is applicable to a back sound screening board that is located near a speaker to improve sound effects.

BACKGROUND OF THE INVENTION

Acoustic apparatus called speakers usually transmit sound by converting electrical sound signals output from an amplifier or the like to sound vibrations by the use of electromagnetic or electrostatic stress, transmitting the sound vibrations to a vibrating board consisting of a cone paper etc., and vibrating air between the vibrating board and a listener's eardrums properly.

Such speakers are ranging for large business concerns, including products for generating loud sounds used by musicians at open-air concerts, household stereos, minicomponents, radio cassette recorders, and headphones. 5.1 channel speakers were also developed and have recently been spreading as household stereos.

FIG. 11 is a horizontal cross-sectional view of a conventional household stereo speaker.

In a conventional speaker system, two speaker units 21, 22 with a speaker box 23 or 24 are employed. The speaker box 23, 24 is required since the speaker unit 21, 22 itself cannot reproduce a sound in a low sound range. The speaker box 23, 24 consists of a resonance box with an appropriate volume obtained by a predetermined calculation. Now, descriptions of the speaker box 23 will be given. The same applies to the speaker box 24. A fitting hole corresponding to the size of the speaker unit 21 is made in a baffle board 25, which forms a front board. The speaker unit 21 is fitted into the hole airtightly so that a vibrating board consisting of a cone paper 27 of the speaker unit 21 blocks the hole. This prevents air from flowing from the inside of the baffle board 25 to the outside of the baffle board 25 and vice versa. The speaker unit 21 is fixed firmly onto the baffle board 25 by inserting, for example, wood screws (not shown) from the front into tapped holes (not shown) in a frame of the speaker unit 21 and tightening them.

The primary object of the baffle board 25 is to isolate a sound wave which is generated in front of the cone paper 27 from a sound wave which is generated behind the cone paper 27 and to prevent them from interfering with each other. In this case, sound waves with phases opposite to each other will be generated. Mixing sound waves with phases opposite to each other, that is to say, a sound wave 5 and a sound wave 5' will result in zero. That is to say, a sound which is generated by the speaker unit 21 will vanish before it can reach a listener's ears 29 and 30.

The wavelength of a sound wave especially at a low compass is long. Even if the listener's ears 29 and 30 are rather far from the speaker unit 21, a shift in the phase of a sound wave is slight. Therefore, the above cancel relationship between two sound waves with phases opposite to each other always exists. Theoretically, the baffle board 25 must consist of a board of infinitely great size so that it can prevent air from flowing from the inside of the baffle board 25 to the outside of the baffle board 25 and vice versa. Moreover, the baffle board 25 itself should be heavy and strong and should not vibrate. Furthermore, the baffle board 25 should be fixed firmly.

When the cone paper 27 moves forward by the electromagnetic driving force of a voice coil (not shown), a high air-density portion (hereinafter referred to as a "positive" for convenience of explanation) appears in front of the cone paper 27 and a low air-density portion (hereinafter referred to as a "negative" for convenience of explanation) appears behind the cone paper 27. On the other hand, when the cone paper 27 moves backward, a low air-density portion (negative) appears in front of the cone paper 27 and a high air-density portion (positive) appears behind the cone paper 27. Isolating the positive from the negative will prevent a sound at a low compass from attenuating.

In this case, "the action of isolating the sound wave 5' (6') with a phase opposite to that of the sound wave 5 (6) generated behind the cone paper 27 (28) from the sound wave 5 (6)" has a great effect. This is called a first operating principle.

There is another type of speaker in which a negative, which appears behind the cone paper 27 when a sound wave moves forward, is converted to a positive in a cylindrical portion (not shown) in the speaker box 23, the positive is radiated from a predetermined hole (not shown) in the baffle board 25, and the cone paper 27 adds force to the positive. Its operating principle is the same with a passive radiator described later with reference to FIG. 12.

In a word, sound waves may cancel out each other by subtraction or may increase their intensity by addition. Therefore, in order to make a speaker, which can reproduce a sound with high fidelity at a predetermined level, it is necessary to design a speaker box or an enclosure, in consideration of the frequency and phase of waves which interfere with each other.

The speaker box 23 usually resonates only the air inside. That is to say, the enclosure member etc. of its resonance box, including the baffle board 25, do not vibrate or resonate. The speaker box 23 is therefore heavy and strong. A wadding-like sound absorbing material 31 is attached to its inner wall. The sound absorbing material 31 absorbs the sound wave 5'. That is to say, the sound absorbing material 31 absorbs harmful waves generated, for example, a sound reflected by the inner wall of the resonance box.

However, such a sealed box does not always achieve theoretically perfect high fidelity sounds so as to be recognized as a standard type as a structure around a speaker unit, because the sound absorbing material 31 could not absorb all the sound waves and slight harmful interference waves remain, and the damper effect due to the closed air within the sealed box restricts a free vibration of the cone paper.

If the enclosure member itself vibrates unnecessarily, then a harsh noise will be produced. Furthermore, if an LP record player is located near the speaker and sounds reproduced by the LP record player is used as a source, a howl may be produced. Therefore, a desired clear sound has been produced by eliminating unnecessary vibrations to the utmost.

This can be said to a frame 15, which supports the cone paper 27 in a vibration-free manner. In other words, the frame 15 is fixed firmly onto the baffle board 25 so that the frame 15 itself does not vibrate.

The well-known fact that "a large, heavy, and strong enclosure etc. for an acoustic apparatus, such as a speaker, which do not vibrate, will produce a clear sound" is based on:

(1) the object of desiring comfortable resonance at a low compass, (2) the object of avoiding the harm of waves with phases opposite to each other canceling out each other, that is to say, the harm of sound failing, and (3) the reason that harm caused by a harsh noise should be avoided.

On the basis of these objects and reason, in a speaker equipped with a resonance boxe consisting of a sealed box etc., a forward and backward movement of the cone paper is limited by air pressure. As a result, a strange sound is produced.

A listener catches not only direct sounds from the cone papers 27 and 28, viz. the L-channel sound wave 5 and the R-channel sound wave 6 but also reverberations produced by an inner wall 32, a floor 33, and a ceiling 34 of a listening room. This is an ordinary listening method.

In this case, even if the same speaker system is used, timbre will vary with the fixtures of the listening room, the location of a listener, or his/her posture. This is a well-known fact.

Unlike the above listening method using a conventional speaker system comprising the speaker boxes 23 and 24, only direct sounds can be transmitted by the use of headphones (not shown). With this method, the distance between the vibrating boards of miniature speakers (not shown) and a listener's eardrums (not shown) is shortened.

In this case, since reverberations do not exist, their comfortable reverberation does not exist. However, there are no waves exit which harmful to the original sound. As a result, the original sound can always be reproduced with high fidelity. If a listener puts on the headphones, timbre will not vary with the fixtures of the listening room, his/her location, or his/her posture. This is well-known and natural. Only temperature, atmospheric pressure, and humidity around a listener's ears may have an influence on the above direct sounds and the influence on the timbre is slight in an ordinary atmosphere.

If members etc. of the headphones used in the second listening method vibrate unnecessarily, a harsh noise will be produced. This is the same with a case where unnecessary vibrations occur in the speaker boxes 23 and 24. Therefore, a clear sound has been reproduced with high fidelity by eliminating unnecessary vibrations to the utmost.

Therefore, the frames etc. (not shown) of the miniature speakers are joined firmly to members etc. (not shown) of the headphones with, for example, an adhesive so that the members etc. of the headphones do not vibrate unnecessarily.

Furthermore, a special speaker system known from the trademark of Body sonic has been used with an easy chair. The speakers have a very relaxing effect on a person by transmitting non-audio ultra-low frequency vibrations directly to the human body not via air but via a member of, for example, the easy chair (not shown). In this case, vibrations are also transmitted to a part of the members and to its cushion portion. This is a conventional example indicating the application of a speaker.

Moreover, unlike conventional speakers having strong enclosures, there are special speakers (not shown) which vibrate their members themselves. These special speakers do not have ordinary cone papers as vibrating portions in their speaker units. Instead, vibration generating portions in their speaker units themselves are fitted directly on design panels or wall boards not via frames etc. and the design panels or wall boards vibrate. As a result, sound is emitted from the design panels or wall boards themselves. This is also a special example in which vibration is transmitted to a member, and a conventional example indicating, for example, a method for fixing speaker units to members.

In the above speakers, regardless of their types, speaker units and fitting portions to which they are fixed are joined reliably with wood screws or an adhesive in order to avoid noise produced by the above unnecessary vibrations.

As stated above, most conventional speakers have resonance boxes to output reproduced sounds efficiently. With those speakers, in order to prevent sound waves with phases opposite to each other generated in front of and behind cone papers from canceling out each other, spaces in front of the cone papers are isolated from spaces behind the cone papers. Furthermore, resonance brings about high and efficient sound output.

With a speaker shown in FIG. 12, however, a "passive-radiation type freely-vibrating board without a driving voice coil 92 etc." (hereinafter referred to as a "passive radiator") 82 and a cone paper 27 of a speaker unit 91 are located on one baffle board.

With this speaker, the driving force of the voice coil 92 causes the cone paper 27 to move forward and backward. As a result, a positive sound wave 5 is generated in front of the cone paper 27 and a negative sound wave 5' is generated behind the cone paper 27. This is the same with a sealed resonance box. The negative sound wave 5' is converted to a positive sound wave by the interference action of a partition board 93 and presses the passive radiator 82 forward. A positive sound wave 50 therefore is generated. As a result, there is the effect of strengthening the sound waves 5 and 50 at a particular frequency.

In this case, "the action of radiating resonating sounds" has a great effect. This is called a second operating principle.

While there is the effect of strengthening sound waves at a particular frequency, there is no denying its unnaturalness.

The most conventional type of speaker is a large-sized stationary speaker consisting of two or more heavy and strong enclosures. These enclosures are independent of one another. If there are two enclosures, one is used only for L-channel sound and the other is used only for R-channel sound. Without a device, it will be difficult for the other types of speaker store produce the original sound with high fidelity and to reproduce heavy low-pitched sounds with presence.

Headphones are well-known as means for listeners to easily and reliably reproduce powerful heavy low-pitched sounds with a stereophonic effect peculiar to a stereo. However, many people dislike them because of their uncomfortableness or obstacle cords.

Therefore, headphones are practicable for business purposes, but they are impracticable for relaxing purposes.

With most headphones, an ear and a speaker unit applied to it are covered together with, for example, a rigid cover with a cushion in order to shut off the ear from sound which comes from the other channel and the outside. Therefore, even when a speaker unit and an ear are a short distance away, sound which comes from the speaker unit will be very faint.

With open headphones, sound which comes from a speaker unit will also be faint when it is moved a short distance from the normal position.

With a compact stereo for, for example, a radio cassette recorder or a television which can receive voice multiplexed stereo broadcasting, a configuration in which one of two speaker units outputs only L-channel sound and the other outputs only R-channel sound maybe adopted. In this case, these two speaker units are located at both ends of one lightweight plastic enclosure (not shown). As a result, L-channel sound waves interfere with R-channel sound waves via the lightweight enclosure. Moreover, the distance between the two speaker units is short, so the L-channel and R-channel sound waves will mix in the air before they reach a listener's ears. That is to say, even if a stereo is used, the listener cannot enjoy its stereophonic effect.

In order to address such problems, the present invention was made. In other words, an object of the present invention is to provide powerful high-fidelity heavy low-pitched sounds and a stereophonic effect, which could obtain only by high-quality headphones or a large-sized speaker, to a listener.

It is preferable that the attenuation of sound should be minimized even in a listening room the sound absorbing structure of which is not desirable in terms of sound effects.

It is preferable that a speaker with the same performance as a conventional one should be priced down.

It is preferable that clear agreeable sounds which relax a listener should be reproduced.

A speaker without a resonance box will be able to meet the above conditions.

Furthermore, it is preferable that a licensee who uses the present invention should be able to realize the most effective results reliably without using the method of trial and error.

It is preferable that material used should be minimized by making effective use of the function of aback sound screening board.

It is preferable that, by adapting an accordion wall or the like for partitioning a room, it should serve not only as a fitting but also as a back sound screening board.

Another object of the present invention is to provide a speaker used in a pillow, being a piece of bedding, or the pillow portion of an easy chair for listening to, for example, music.

Still another object of the present invention is to provide a miniature, lightweight, and low-cost speaker which can reproduce clear sounds not only to conventional audio and video apparatus but also to electric and electronic apparatus for which importance has not been attached to tone quality.

SUMMARY OF THE INVENTION

According to one aspect of the present invention, a speaker unit, a direct sound transmitting section for transmitting only direct sounds which come from the front of the speaker unit, and a back sound screening section for screening out indirect sounds which come from the back of the speaker unit and travel forward are included.

This enables to determine material for a structure around a speaker unit, the size, formation, and shape of the structure more freely. A novel design therefore can be produced without being swayed by the formation and shape of a conventional speaker system. As a result, a speaker system of higher quality can be provided easily.

According to another aspect of the present invention, in a speaker system in which a speaker unit is located on a hole portion made in a baffle board, a frame of the speaker unit is attached to the baffle board so that the frame of the speaker unit can move freely in the direction in which a cone paper vibrates with strokes being much the same as the amplitude of the vibrations of the cone paper.

This enables to remove a massive resonance box and to reproduce sound with high fidelity.

A lightweight baffle board without a resonance box functions as a back sound screening board. Even if the baffle board is not fixed firmly, the same sound that is reproduced by a large-sized high-output speaker can be obtained by a small-sized low-output speaker.

Therefore, a speaker with the same performance as a conventional one can be priced down.

In addition, there is no resonance box, so particular resonance frequencies are not exalted unnaturally. Therefore, clear agreeable sounds which relax a listener are reproduced.

The baffle board functions especially to prevent low-pitched sounds from canceling out each other. As a result, clear, powerful, and high-fidelity reproduced sounds can be obtained without a resonance box.

Space occupied by a speaker can be minimized, which enables a freer arrangement.

Moreover, harmful waves are absorbed between a frame of the speaker unit and the baffle board, so a howling phenomenon can be prevented. That is to say, sound reproduced by a speaker according to the present invention will not adversely affect sound reproduced by an LP record player located on a floor where the speaker is located.

According to still another aspect of the present invention, a fitting guide with a concave portion which can house the frame with room outside the edge of the frame is formed around the hole portion made in the baffle board and the frame is located in the concave portion through a vibration absorbing member.

With an enclosure molded out of, for example, resin, this enables to use the above aspect of the invention easily without increasing the number of parts or assembly processes significantly.

According to still another aspect of the present invention, a fitting guide with a concave portion which can house the frame or an outer portion joined unitarily to the frame with room outside the edge of the frame or the outer portion is included and the frame or the outer portion is located in the concave portion with a vibration absorbing member between.

This enables to use the above aspect of the invention easily regardless of materials, such as resin or wood, for a supporting member, an enclosure, and the like or the external shape, size, and weight of a speaker unit.

According to still another aspect of the present invention, the fitting guide being another part is included.

This enables to use the above aspect of the invention easily on apparatus using a speaker of any shape regardless of materials, such as resin or wood, for a supporting member, an enclosure, and the like or the external shape, size, and weight of a speaker unit.

Furthermore, this fitting guide is popular among acoustic maniacs for being able to be attached to a ready-made article. The fitting guide and the vibration absorbing member can be sold separately from a speaker.

According to still another aspect of the present invention, in a speaker in which speaker units for outputting L-channel sound and R-channel sound independently to produce a stereophonic effect are located so that the speaker units face a listener's left and right ears respectively, an L-channel dedicated speaker unit, a first baffle board for holding the L-channel dedicated speaker unit flexibly with a vibration absorbing member between, an R-channel dedicated speaker unit, a second baffle board for holding the R-channel dedicated speaker unit flexibly with a vibration absorbing member between, and a vibration absorbing member between the first baffle board and the second baffle board are included and the first baffle board and the second baffle board are joined flexibly.

As a result, the uncomfortableness of headphones does not exist. Furthermore, when a speaker system and an ear are a short distance away, sound which comes from the speaker system will not be very faint.

Low-pitched sounds are not canceled and the distinction between the L-channel and the R-channel will not vanish. Moreover, harmful indirect sounds are eliminated by a sound absorbing material and only direct sounds reach a listener's ears. Therefore, powerful high-fidelity heavy low-pitched sounds and a stereophonic effect, which could obtain only by quality headphones or a large-sized speaker system, can be provided to a listener.

In addition, ears are not blocked. When a speaker unit and an ear are a short distance away, sound which comes from the speaker unit will not be very faint. A listener also hears sound which comes from the outside. In these respects, a speaker system according to this aspect of the present invention and headphones differ. That is to say, a speaker system according to this aspect of the present invention combines the advantages of a conventional speaker system with a resonance box and those of headphones.

Moreover, there is no need to locate two separate speaker boxes for the L-channel and the R-channel. A speaker system according to this aspect of the present invention uses one compact, lightweight, and simple speaker box, so it has a wide range of applications. For example, it is applicable to a simulation training apparatus or simulation game apparatus as a part of equipment for audiovisual education.

According to still another aspect of the present invention, speaker units embedded within a pillow, being a piece of bedding, or the pillow portion of an easy chair and a cushion material which serves not only as a cushion material for the pillow or the pillow portion but also as the direct sound transmitting section and the back sound screening section are included.

This enables to utilize a cushion material for a pillow. Furthermore, in spite of a compact lightweight speaker embedded within a pillow, it will equal a large-sized speaker in performance.

According to still another aspect of the present invention, short tubes of hard resin with a thickness of between 0.5 and 1.5 millimeters, an outside diameter of between 5 and 15 millimeters, and a length of between 5 and 20 millimeters are included in the direct sound transmitting section and the back sound screening section.

This specifies the qualities and approximate size of materials which form the direct sound transmitting section and the back sound screening section. A licensee who uses the present invention therefore can realize the most effective results reliably without using the method of trial and error.

According to still another aspect of the present invention, a base in which cavities for housing speaker units are formed on the top of a vibration absorbing member having great air-permeability and elasticity, speaker units housed in the cavities with sound emitting surfaces of the speaker units faced outward, protective members for protecting the sound emitting surfaces of the speaker units, and a cushion material for a pillow comprising the short tubes of hard resin which covers the sound emitting surfaces are included.

This enables to utilize a member, which has a very relaxing effect as material for a pillow itself, as a single supporting structure for speaker units, to obtain optimum acoustic characteristics, and to hold them flexibly in proper positions with respect to a user's ears. Moreover, the number of parts and assembly processes can be minimized. In spite of a compact lightweight speaker used in a pillow, it will equal a large-sized speaker in performance.

Its structure is simple and strong. Furthermore, only a pillow material which touches a user's head can be removed and washed easily. It therefore is very practical.

According to still another aspect of the present invention, back sound screening boards which are located nearly on a plane extending from the edge of a vibrating board of a speaker so that space in front of the vibrating board is isolated from space behind the vibrating board and which are faced at almost right angles to a listener are included.

This enables to remove a massive resonance box and to reproduce sound with high fidelity. The loudness of sound reproduced by a small-sized low-output speaker is equal to that of sound reproduced by a large-sized high-output speaker.

Moreover, the attenuation of sound is minimized even in a listening room the sound absorbing structure of which is not desirable in terms of sound effects. Therefore, a speaker with the same performance as a conventional one can be priced down.

In addition, there is no resonance box, so particular resonance frequencies are not exalted unnaturally. Therefore, clear agreeable sounds which relax a listener are reproduced.

According to still another aspect of the present invention, back sound screening boards having a mechanism in which the relative positions are maintained without touching a speaker frame or by connecting with a speaker frame flexibly are included.

This enables to make effective use of the function of the back sound screening boards.

According to still another aspect of the present invention, folding back sound screening boards are included.

As a result, by adapting an accordion wall or the like for partitioning a room, it can be used not only as a fitting but also as a back sound screening board. By doing so, the existence of a back sound screening board is not very prominent, the problem of space is solved, and psychological oppression caused by conventional large-sized acoustic equipment and the like can be relieved.

According to still another aspect of the present invention, the back sound screening boards which are made of a foamed chloroethylene board, a wooden board, or a veneer board, have a thickness of between 1 and 10 millimeters, and have a maximum expanded external size of 3 meters or less from the center of a speaker unit are included.

This specifies the qualities and approximate size of materials for a combination of a medium- or small-sized speaker unit supported with a vibration absorbing structure and back sound screening boards. A licensee who uses the present invention therefore can realize the most effective results reliably without using the method of trial and error.

According to still another aspect of the present invention, a mat with a hole portion is further provided as the back sound screening section and is mainly constructed by a bag sealing therein liquid or gel, and the surface of the cone paper is ventilated through the hole portion.

According to still another aspect of the present invention, a shape and a mounting position of the mat is the same as those of the baffle board.

With these constitutions, pure and clear sound can be obtained effectively without requiring a heavy and strong baffle board.

Accordingly, it can be applicable to an object which dislikes heaviness or stiffness, and it can meet a demand on some bending. For example, it is applicable to an object which directly touches to a human body, because of its excellent touch.

According to another aspect of the present invention, a vibration absorbing member mainly constructed by a bag sealing therein liquid or gel is positioned between the baffle board and the frame.

According to still another aspect of the present invention, the frame is located in the concave portion through a vibration absorbing member mainly constructed by a bag sealing therein liquid or gel.

In these constitutions, because the elastic vibration absorbing effect extends for a long term, in comparison with the conventional structure where the vibration absorbing member is mainly formed by a single material, such as urethane foam (sponge) or rubber, the service life of the product can be extended.

According to still another aspect of the present invention, constrictions are made on the bag sealing therein liquid or gel, and an irregular surface is formed by a recess-shaped or wave-shaped unevenness due to the constrictions.

Such a constitution achieves the vibration absorbing effect as good as the structure where the vibration absorbing member is mainly formed by a foamed porous material, such as urethane foam (sponge).

In comparison with gas or sponge, liquid or gel is smaller in volume change amount when applying pressure, and therefore liquid or gel is not used as a spring if it is sealed in a piston or the like. For this reason, the vibration absorbing effect achieved by the liquid or gel sealed in the bag mainly relies on a change in the shape, and not a volume change. It is essential to keep a space for escaping the liquid or gel upon changing by a load. In the above constitution, the recess-shaped or wave-shaped uneven surface provides the escaping space for the deformed and projecting part.

Further, the recess-shaped or wave-shaped unevenness ensures air permeability and prevents the front and back of the cone paper from being separately sealed. Therefore, the advantages of the non-separate seal can be sufficiently achieved and thus high fidelity sound can be supplied.

In other words, various disadvantages can be eliminated, such as the drawback that free vibration of the cone paper is restricted due to the damper effect by the sealed air within the sealed box, and the drawback that only a certain frequency band is emphasized by the resonance box and a sound output in other frequency band is restricted.

According to a further aspect of the present invention, the bag mainly consists of silicone rubber.

According to another aspect of the present invention, the gel has a stiffness and elasticity barely retaining its shape at room temperatures, and the bag is mainly formed by silicone rubber in the thickness of between 0.05 to 1 millimeter.

According to still another aspect of the present invention, the gel is mainly formed by a high water absorbability polymer consisting acrylamide cross-linking structure.

With these specific constitutions of the vibration absorbing member, which supports the frame, the most effective result can be easily obtained by a person skilled in the art.

According to still another aspect of the present invention, the structure around a speaker unit according to any of the above aspects is applied to an electric or electronic apparatus for producing sound.

As a result, electric and electronic apparatus for which importance has not been attached to tone quality can also use a miniature, lightweight, and low-cost speaker which can reproduce clear sounds.

BRIEF DESCRIPTION OF THE DRAWINGS

FIG. 13 shows a first embodiment of the present invention by way of design drawing, in which

FIG. 14 shows a second embodiment of the present invention by way of design drawing, in which

FIG. 15 shows a third embodiment of the present invention by way of design drawing, in which

FIG. 16 shows a fourth embodiment of the present invention by way of design drawing, in which

DESCRIPTION OF THE PREFERRED EMBODIMENTS

Embodiments of the present invention will now be described with reference to the drawings.

Figure 1:
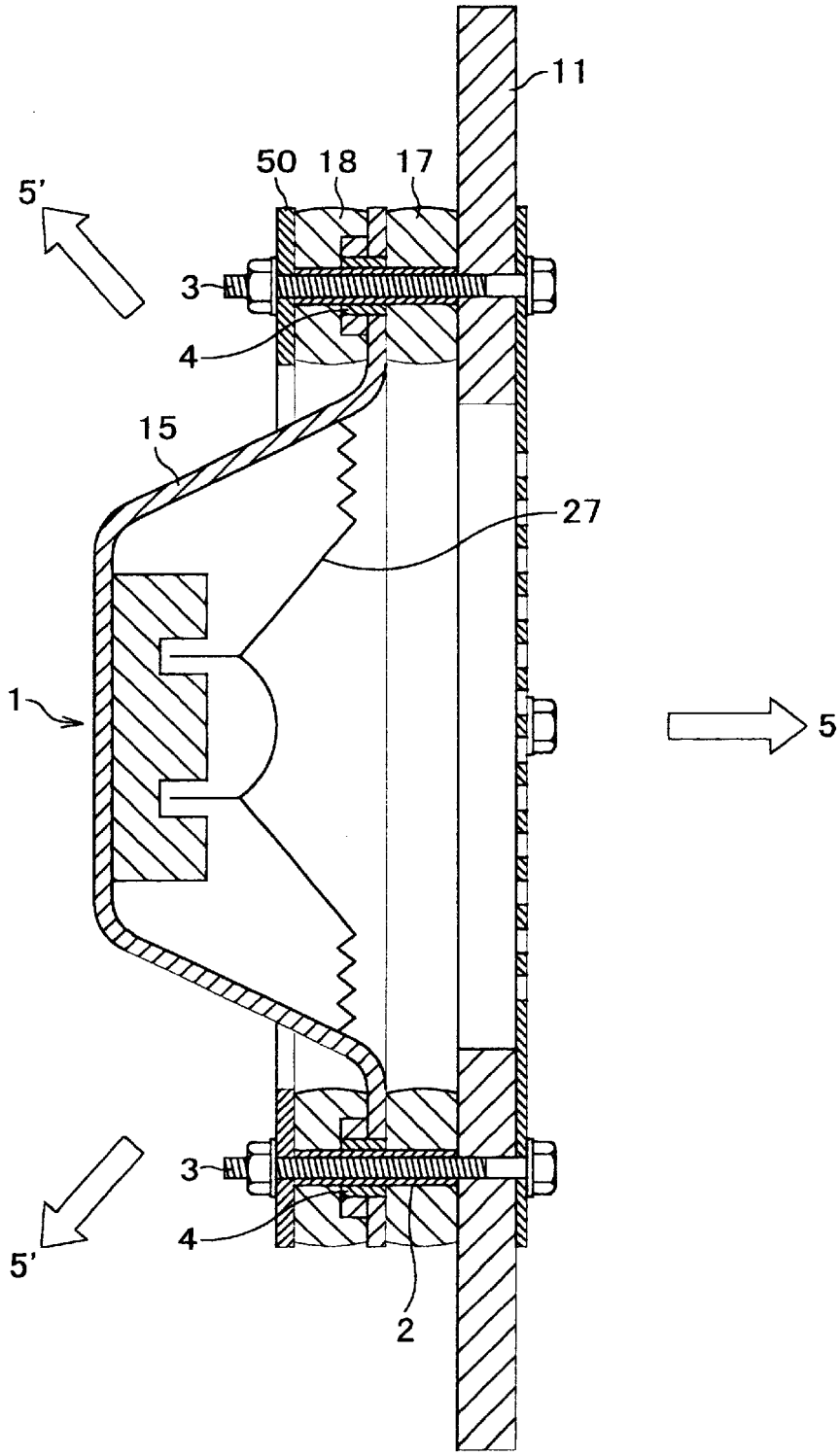
FIG. 1 is a cross-sectional view of a speaker showing a "basic" embodiment of the present invention.

FIG. 1 is a cross-sectional view of a speaker showing a "basic" embodiment of the present invention.

With the embodiment shown in FIG. 1, in a speaker in which a speaker unit 1 is located on a hole portion made in a baffle board 11, a frame 15 of the speaker unit 1 is attached flexibly to the baffle board 11 so that the frame 15 can move in the direction in which a cone paper 27 vibrates, that is to say, forward and backward freely with strokes being much the same as the amplitude of the vibrations of the cone paper 27. In this case, vibrations generated in the speaker unit 1 are absorbed so that they are not transmitted to the baffle board 11.

A prop 3 most of the surface of which is smoothed, for example, by coating with a collar 2 pierces through the baffle board 11 at the edge portion of the hole made in it. A male screw is cut into the edge portion of the prop 3 and a position regulating member 50 is bolted down at a predetermined position. A sleeve 4 is attached to a screw hole made in the frame 15. The prop 3 fits into the sleeve 4 with the collar 2 between and the forward and backward motion of the sleeve 4, that is to say, the forward and backward motion of the frame 15 is regulated flexibly by the elastic force of vibration absorbing members 17 and 18 of urethane foam (sponge).

In the speaker shown in FIG. 1, sound waves 5 and 5' with phases opposite to each other are radiated from the speaker unit 1 in the forward and backward directions respectively. In this case, the sound wave 5 in front of the baffle board 11 is isolated to some extent from the sound wave 5' behind the baffle board 11 by the baffle board 11, so these sound waves will not cancel out each other by addition.

The area of the baffle board 11 is finite and some of the sound wave 5' will travel to the front of the baffle board 11 around its edge. For example, however, its route to a listener's ears (not shown) is not straight. The sound wave 5' therefore will significantly attenuate before it can reach the ears. That is to say, the sound wave 5' almost never interferes with the sound wave 5. As a result, low-pitched sounds included in the sound wave 5 almost never attenuate.

If there are no obstructions and the like between the speaker unit 1 and a listener's ears which absorb or obstruct the sound wave 5, being direct sounds, then the sound wave 5 almost never attenuates. As a result, the original sound will be reproduced with high fidelity.

It is assumed that the total weight of the frame 15, including a magnet and the like, and the baffle board 11 is zero and that the frame 15 and the baffle board 11 are not attached firmly. Then when the cone paper 27 moves forward by the electromagnetic driving force of a voice coil (not shown), the frame 15 moves backward as a reaction and the baffle board 11 supporting the frame 15 also moves backward. At this time, the sound wave 5' which interferes with the sound wave 5 is radiated in the backward direction.

This prevents the original sound from being reproduced with high fidelity. Methods for preventing the generation of the sound wave 5' are as follows:

1) Attach the frame 15 firmly so that it does not vibrate.
2) Make the area of the baffle board 11 infinitely great, and attach the baffle board 11 firmly so that it does not vibrate.
3) Make the weight of the frame 15 and the baffle board 11 infinitely great so that they are hard to vibrate.
4) Use a conventional strong massive speaker box.

Methods 1), 2), and 3) do not have various uses and are unreal. Method 4) is not suitable for a compact, lightweight, and low-cost speaker system. The frame 15 therefore should be vibrated freely. While the weight of the frame 15 including a magnet has recently reduced with the progress of magnet materials, the weight of the frame 15 including the magnet is far greater than the total weight of a voice coil (not shown) and the cone paper 27. Moreover, usually the area of the frame 15 which vibrates air is smaller than that of the cone paper 27. Therefore, the sound wave 5' generated by the frame 15 itself is negligible.

However, if the baffle board 11 is connected inseparably to the frame 15, the total area will be fairly great. Therefore, a bad influence which the sound wave 5' generated by them will have on the sound wave 5 is far from negligible.

Even if the frame 15 is vibrated freely, only the sound wave 5, being direct sounds, can be sent from the cone paper 27 to a listener's ears by preventing the vibrations from being transmitted to the baffle board 11.

Furthermore, the baffle board 11 resonates to some extent by the sound wave 5 and radiates the sound wave 5 of increased intensity in the forward direction. That is to say, the baffle board 11 functions as what is called an "acoustic resonance reflecting board."

As a result, without using a resonance box, the attenuation of heavy low-pitched sounds can be prevented and sound can be reproduced with high fidelity.

In this case, both of the above first operating principle, "the action of isolating the sound wave 5' with a phase opposite to that of the sound wave 5 generated behind the cone paper 27 from the sound wave 5," and the above second operating principle, "the action of radiating resonating sounds," will have much effect.

Figure 2:
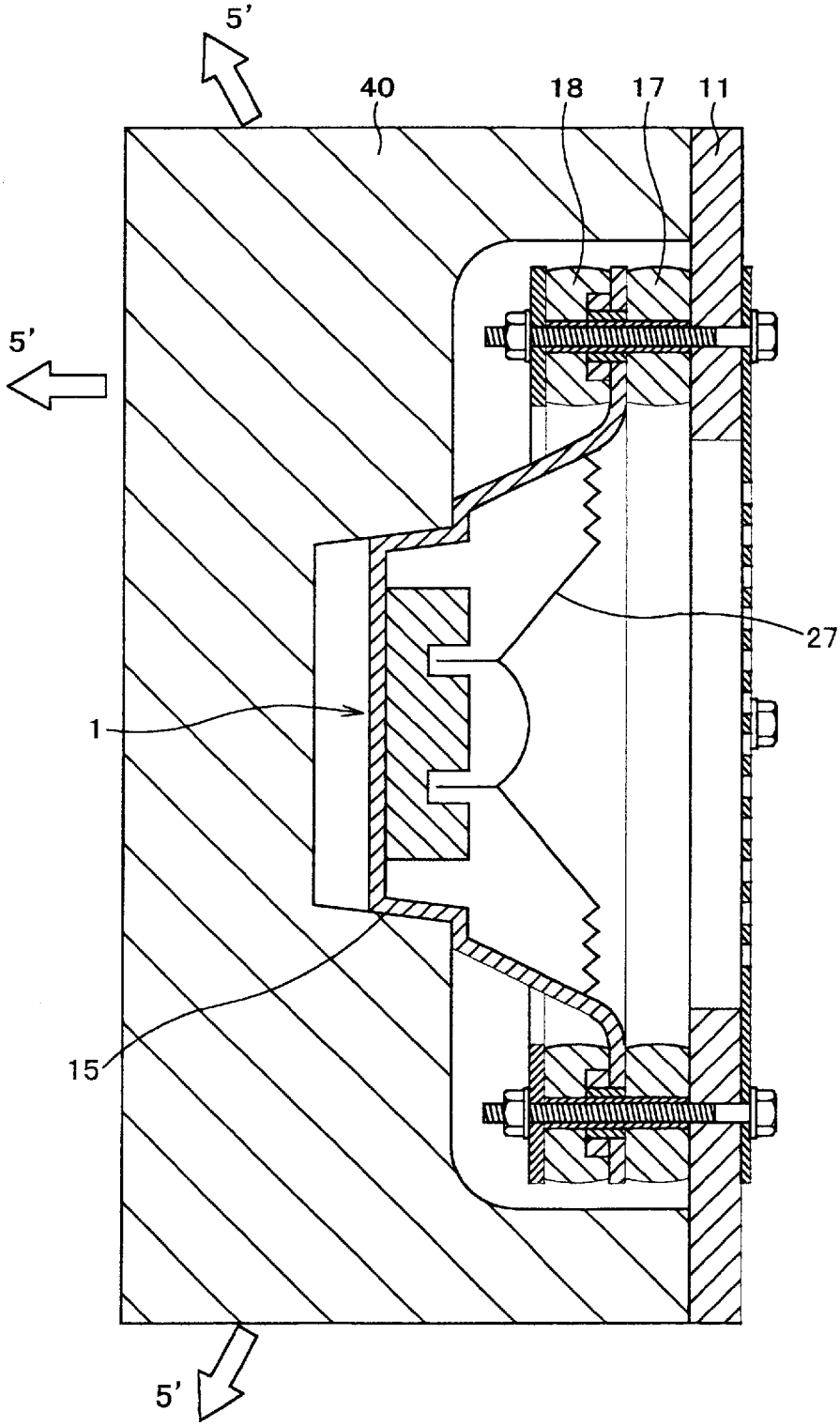
FIG. 2 is a cross-sectional view of a speaker showing an "embedded-type" embodiment of the present invention.

FIG. 2 is a cross-sectional view of a speaker showing an "embedded-type" embodiment of the present invention.

In the embodiment shown in FIG. 2, a frame 15 of a speaker unit 1 is located flexibly on a baffle board 11 with vibration absorbing members 17 and 18. This is the same with the embodiment shown in FIG. 1. The back of the speaker unit 1 is covered with a member 40 of fibers having great elasticity, great air-permeability, and moderate rigidity so that the sound wave 5' radiated from behind the speaker unit 1 into surrounding space does not reach a listener (not shown) who is in front of the speaker unit 1. This will reduce a bad influence which a sound wave radiated from behind the speaker unit 1 has on the sound wave 5.

As a result, the function of isolating and absorbing indirect sounds including harmful sound waves, being an effect obtained by a speaker shown in FIG. 1, can be strengthened by the effect of the sound absorbing material.

As a result of various experiments on material for the member 40, "Curllock (registered trademark of the Takagi Chemistry Laboratory)" regenerated from plastic bottles gave good results.

In the embodiment shown in FIG. 2, the frame 15 is located flexibly on the baffle board 11 with the vibration absorbing members 17 and 18. This is the same with the embodiment shown in FIG. 1. However, experiments showed that a significant effect is obtained only by the member 40. Therefore, even if the frame 15 is fixed to the baffle board 11 firmly and inseparably, an effect obtained by a speaker using the member 40 will be much the same as one obtained by a speaker using a resonance box.

Furthermore, a rubber mat with a thickness of about 3 millimeters may be used instead of the baffle board 11 used in the embodiment shown in FIG. 2. That is to say, unlike the structure shown in FIG. 1, the weight of the speaker unit 1 is supported with the member 40. The above first operating principle, "the action of isolating the sound wave 5' with a phase opposite to that of the sound wave 5 generated behind the cone paper 27 from the sound wave 5," has much effect.

Furthermore, instead of the baffle board 11 working as the back sound screening board, a mat with a hole portion may be employed. The mat is mainly constituted by a sealed bag made of silicone and in the thickness of 0.2 millimeters, and liquid or gel sealed in the bag and restricted to a certain shape. In order to ventilate the surface of the cone paper through the hole portion, the cone paper may be substantially exposed toward the listener's ear in such a way that the cone paper can be seen through the net.

In this constitution, pure and clear sound can be obtained effectively without requiring a heavy and strong baffle board.

Further, since the mat is made with a flexible material and its surface and the core are flexible to allow some bend, it can be applicable to an object which dislikes heavy and stiff touch. For example, it is applicable to an object which directly touches to a human body, because of its excellent touch.

In FIGS. 1 and 2, the frame 15 is located flexibly on the baffle board 11 with the vibration absorbing members 17 and 18. In these cases, the frame 15 of the speaker unit 1 is attached flexibly to the baffle board 11 so that the frame 15 can move freely with strokes of 1 millimeter or more in the direction in which the cone paper 27 vibrates. There exists a "fitting structure from the speaker unit 1 to the baffle board 11 having an L-, J-, or U-shaped cross section."

Figure 3B:
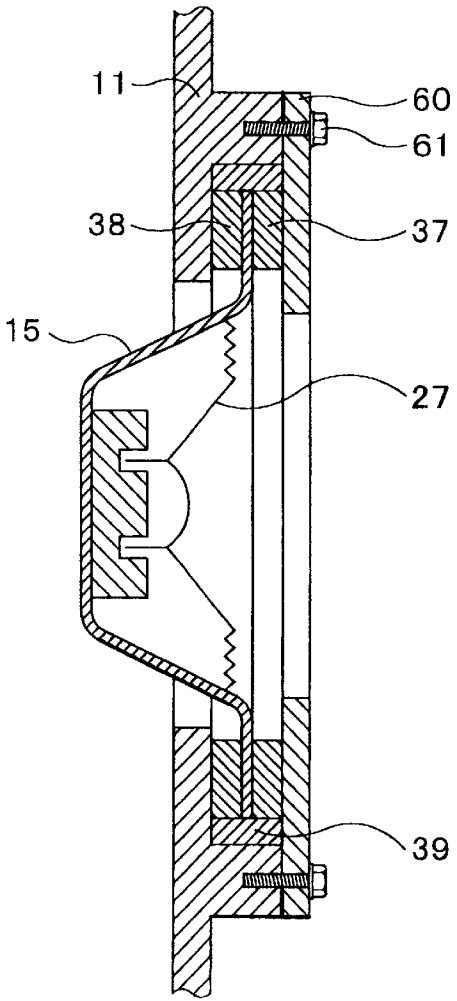
FIG. 3B is a cross-sectional view showing an embodiment of a structure around a speaker unit according to the present invention having a "fitting structure having an L-, J-, or U-shaped cross section the open edge of which a ring member is fixed to."
Figure 3A:
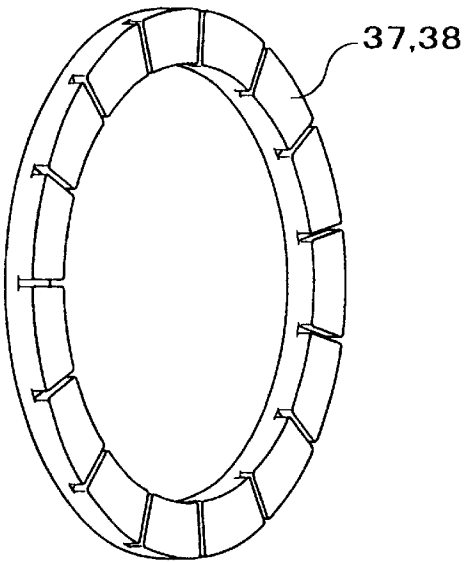
FIG. 3A shows a vibration absorbing member, in which a bag sealing liquid or gel is provided with constrictions and an irregular surface is formed by a recess-shaped or wave-shaped unevenness due to the constrictions.

In FIG. 3A, a fitting guide having an L-shaped cross section which can house a frame 15 with room outside the edge of the frame 15 is formed around a hole made in a baffle board 11. Vibration absorbing members 38 and 39 are fitted into a concave portion of the fitting guide. A vibration absorbing member 37 is located so that the edge portion of the frame 15 is put among the vibration absorbing members 37, 38, and 39. A ring member 60 is fixed to the open edge of the concave portion of the fitting guide by a screw 61 so that the vibration absorbing members 37, 38, and 39 and the frame 15 do not come off the baffle board 11.

As a result, the edge portion of the frame 15 is attached flexibly to the baffle board 11 with the vibration absorbing members 37, 38, and 39 so that the edge portion of the frame 15 can move freely in the direction in which the cone paper 27 vibrates with strokes being much the same as the amplitude of the vibrations of the cone paper 27.

Even if the cone paper 27 vibrates in the forward and backward directions, the vibration absorbing members 37, 38, and 39 absorb its reactions so that they are not transmitted from the edge portion of the frame 15 to the baffle board 11. As a result, the effect of the present invention can be obtained.

If the baffle board 11 is, for example, an enclosure molded out of resin, the present invention can be used easily without increasing the number of parts or assembly processes significantly.

Figure 5B:
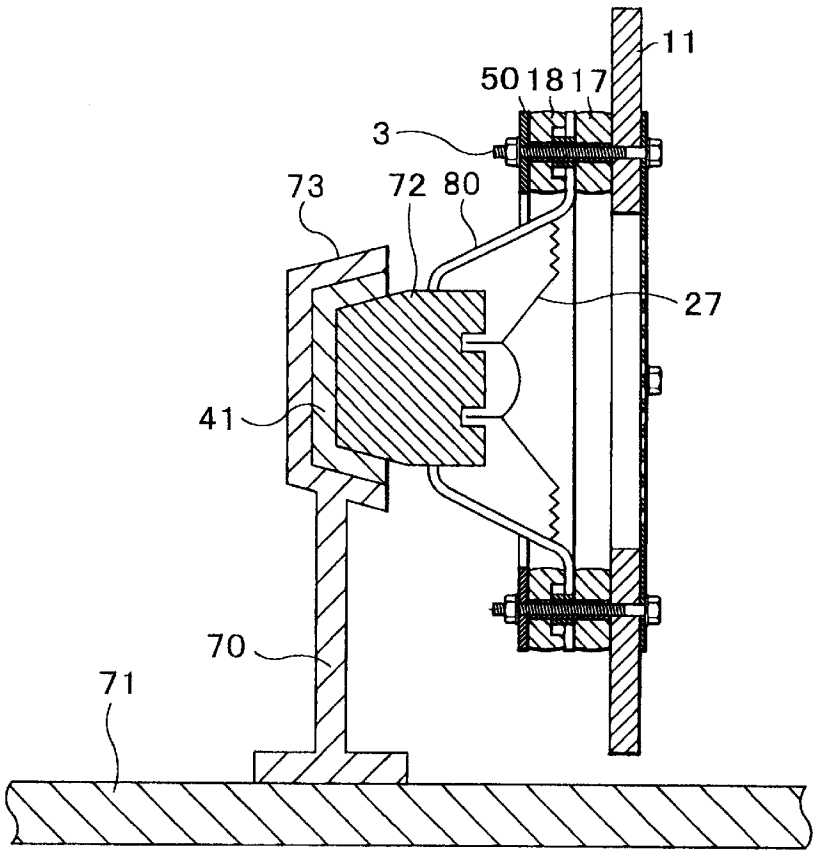
FIG. 5B is across-sectional view showing an embodiment of a structure around a speaker unit according to the present invention which includes not only the "basic" structure shown in FIG. 1 but also a "supporting structure in which a rear magnet is loosely fitted into a concave portion with a vibration absorbing member between" for supporting the weight of the rear magnet.
Figure 5A:
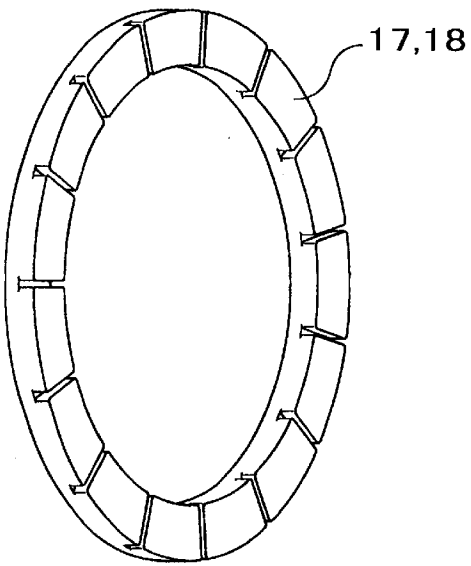
FIG. 5A shows a vibration absorbing member substantially the same as that shown in FIG. 3A.
Figure 7A:
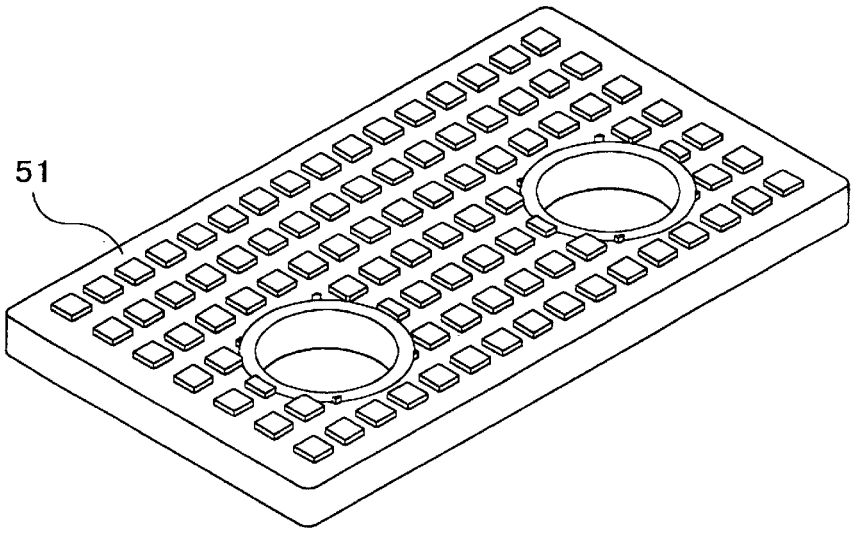
FIG. 7A shows a back sound screening board, in which a bag sealing liquid or gel is provided with constrictions and an irregular surface is formed by a recess-shaped or wave-shaped unevenness due to the constrictions, and it can be applicable as a baffle board.

As shown in FIGS. 3A, 5A and 7A, the back sound screening board 51, the baffle board 11 (the whole weight is supported by other parts) and the vibration absorbing member 17, 18, 37, 38, 39 may be made mainly from a bag sealing therein liquid or gel. However, screw holes of the vibration absorbing member 17, 18 are omitted from the figures. The detailed structure for mounting the baffle board 11 is also omitted.

The frame 15 may be positioned on the baffle board 11 with the vibration absorbing member 37, 38 placed in the concave portion.

Further, the bag is provided with constrictions, and an irregular surface is formed on the baffle board 11 or the vibration absorbing member 17, 18, 20, 37, 38, 39 by a recess-shaped or wave-shaped unevenness due to the constrictions.

Such a constitution achieves the vibration absorbing effect as good as the structure where the vibration absorbing member is mainly formed by a foamed porous material, such as urethane foam (sponge).

In comparison with gas or sponge, liquid or gel is smaller in volume change amount when applying pressure, and therefore liquid or gel is not used as a spring if it is sealed in a piston or the like. For this reason, the vibration absorbing effect achieved by the liquid or gel sealed in the bag mainly relies on a change in the shape, and not a volume change. It is essential to keep a space for escaping the liquid or gel upon changing by a load. In the above constitution, the recess-shaped or wave-shaped uneven surface provides the escaping space for the deformed and projecting part.

Further, because the elastic vibration absorbing effect extends for a long term, in comparison with the conventional structure where the vibration absorbing member is mainly formed by a single material, such as urethane foam (sponge) or rubber, the service life of the product can be extended.

The bag is made by molding fibers mainly consisting of silicone rubber in the thickness of 0.2 millimeter, and at the constrictions the recess-shaped or wave-shaped unevenness functions as a ventilation hole. Therefore, it is possible to keep air permeability, and thus preventing the front and back of the cone paper from being separately sealed.

Accordingly, the sealed resonance box is not required, and an improved effect by releasing the air behind the cone paper from the separate seal can be sufficiently enjoyed.

In other words, various disadvantages can be eliminated, such as the drawback that free vibration of the cone paper is restricted due to the damper effect by the sealed air within the sealed box, and the drawback that only a certain frequency band is emphasized by the resonance box and a sound output in other frequency band is restricted.

With this constitution, the most effective result was obtained in a reliable manner.

For this reason, it is possible to presume that the gel having a certain viscosity well-absorbs interference waves causing impure sound.

As a problem upon manufacturing, it is difficult to keep desired shapes and qualities if the thickness of the bag is less than 0.05 millimeters. A desired shape cannot be kept if the bag is like a rubber balloon, and a certain durability cannot be obtained because it is fragile.

Meanwhile, if the thickness is over 1 millimeter, desired shapes and qualities can be kept. However, the stiffness of silicone rubber deteriorates the vibration absorbing effect.

At present, the best result is obtained when gelatinous gel having viscosity, rigidity and elasticity barely retaining its shape is sealed in a silicone rubber bag in the thickness of 0.2 millimeters.

Specifically, the gel is mainly formed by a high water absorbability polymer consisting acrylamide cross-linking structure. For example, "SNOWPACK" (registered trademark of Mitsubishi Chemicals Corp.) is used for experimental studies. The SNOWPACK is gel sealed in a bag and is commercially available for a domestic keeping cool material. Because the gel keeps its shape by the gelatinous viscosity, rigidity and elasticity, it brings the best result for carrying out the present invention.

Figure 4A:
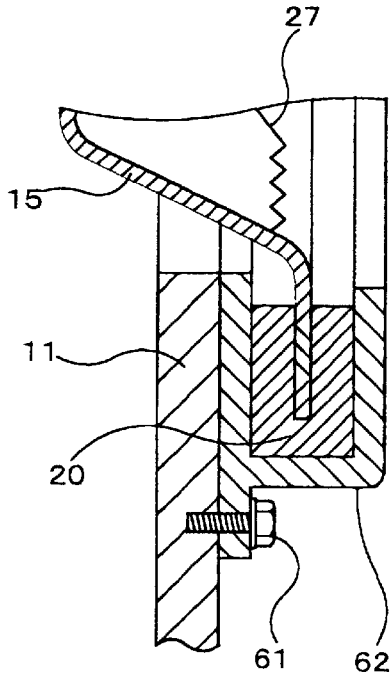
FIGS. 4A and 4B are enlarged cross-sectional views showing a feature of an embodiment of a structure around a speaker unit according to the present invention having a "fitting structure as a part before assembly having a J-, U-, or h-shaped cross section," FIG. 4A being an enlarged cross-sectional view in the case of a speaker unit being fixed from this side of a baffle board 11 and FIG. 4B being an enlarged cross-sectional view in the case of a speaker unit being fixed from the back of the baffle board 11.
Figure 4B:
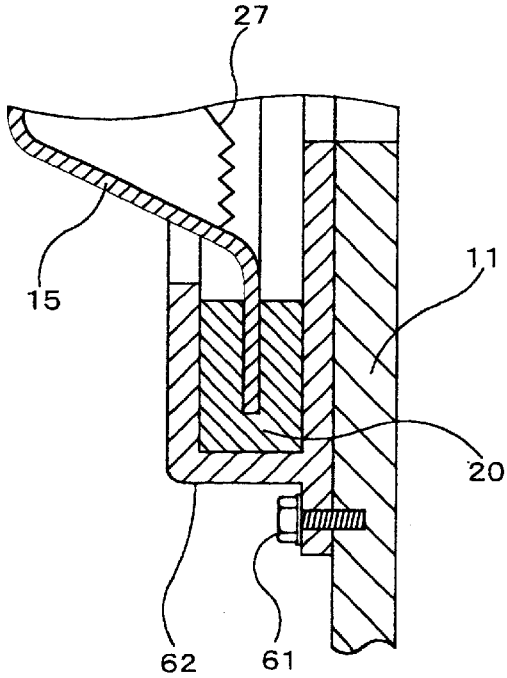

FIGS. 4A and 4B are enlarged cross-sectional views showing a feature of an embodiment of a structure around a speaker unit according to the present invention having a "fitting structure as a part before assembly having a J-, U-, or h-shaped cross section."

In FIG. 4A, a speaker unit is fixed from this side of a baffle board 11. In FIG. 4B, a speaker unit is fixed from the back of the baffle board 11.

In FIGS. 4A and 4B, a fitting guide 62 with a concave portion having a J-, U-, or h-shaped cross section which can house a frame 15 with room outside the edge of the frame 15 is fixed to the fringe of a hole made in the baffle board 11 with a screw 61. A vibration absorbing member 20 is fitted into the concave portion of the fitting guide 62. The vibration absorbing member 20 is located so as to cover the edge portion of the frame 15. The frame 15 is attached flexibly to the baffle board 11 with the vibration absorbing member 20 so that the frame 15 can move freely in the direction in which the cone paper 27 vibrates with strokes being much the same as the amplitude of the vibrations of the cone paper 27.

Even if the cone paper 27 vibrates in the forward and backward directions, the vibration absorbing member 20 absorbs its reactions so that they are not transmitted from the edge portion of the frame 15 to the baffle board 11. As a result, the effect of the present invention obtained in the embodiment shown in FIG. 1 can be realized.

Experiments showed that the structure shown in FIG. 4A gives better results than that shown in FIG. 4B. The reason for this is that, in FIG. 4A, the cone paper 27 is in front of the baffle board 11, that is to say, sound is hard to be muffled.

FIG. 5A shows a vibration absorbing member substantially the same as that shown in FIG. 3A, and FIG. 5B is a cross-sectional view showing an embodiment of a structure around a speaker unit according to the present invention which includes not only the "basic" structure shown in FIG. 1 but also a "supporting structure in which a rear magnet is loosely fitted into a concave portion with a vibration absorbing member between" for supporting the weight of the rear magnet.

In FIG. 5, the edge portion of a frame 80 is attached flexibly to the fringe of a hole made in a baffle board 11 with vibration absorbing members 17 and 18 so that the frame 80 can move freely with strokes of 1 millimeter or more in the direction in which a cone paper 27 vibrates. This attachment form is much the same as that shown in FIG. 1. Therefore, descriptions of a prop 3 and a structure around it will be omitted. In a word, the vibration absorbing members 17 and 18 are located between a position regulating member 50 and the baffle board 11 with the edge portion of the frame 80 between.

A supporting base 70 has a fitting guide 73 with a concave portion on it. A large magnet 72 connected inseparably to the frame 80 is supported by the fitting guide 73 with a vibration absorbing member 41 in the concave portion between.

This prevents the vibrations of the large magnet 72 connected inseparably to the frame 80 from being transmitted to the supporting base 70 and a floor 71. As a result, the same effect that is obtained in the embodiment of the present invention shown in FIG. 1 can be realized in any embodiment regardless of the type of material for the supporting base 70 or the shape, size, and weight of a speaker unit.

In the embodiments shown in FIGS. 1, 2, 3, 4, and 5, "Memory Foam (registered trademark of the KCC Company)" was used as material for the vibration absorbing members 17, 18, 20, 37, 38, 39, and 41 and good results were given. However, embodiments in which material having the same elastic force, dump effect, and the like as it or a modification of the above vibration absorbing structures is used can be regarded as falling within the scope of the present invention.

In the basic embodiment of the present invention, a resonance box is not used and a light baffle board not fixed firmly is used. However, applying the above vibration absorbing structures to a speaker unit with a conventional resonance box and a heavy baffle board fixed firmly to the resonance box will give interesting results. That is to say, clearer reproduced sounds are obtained.

Therefore, even if the present invention is applied to a speaker with a conventional resonance box and a heavy baffle board, it can be regarded as falling within the scope of the present invention.

Weak electric wires (not shown) and the like connected to a speaker unit which need a predetermined protection and devices regarding design can be easily imagined by those skilled in the art. Descriptions of them therefore will be omitted.

Now, embodiments in which the present invention is applied to a pillow, being a piece of bedding, will be described with reference to FIGS. 6 and 7.

Figure 6:
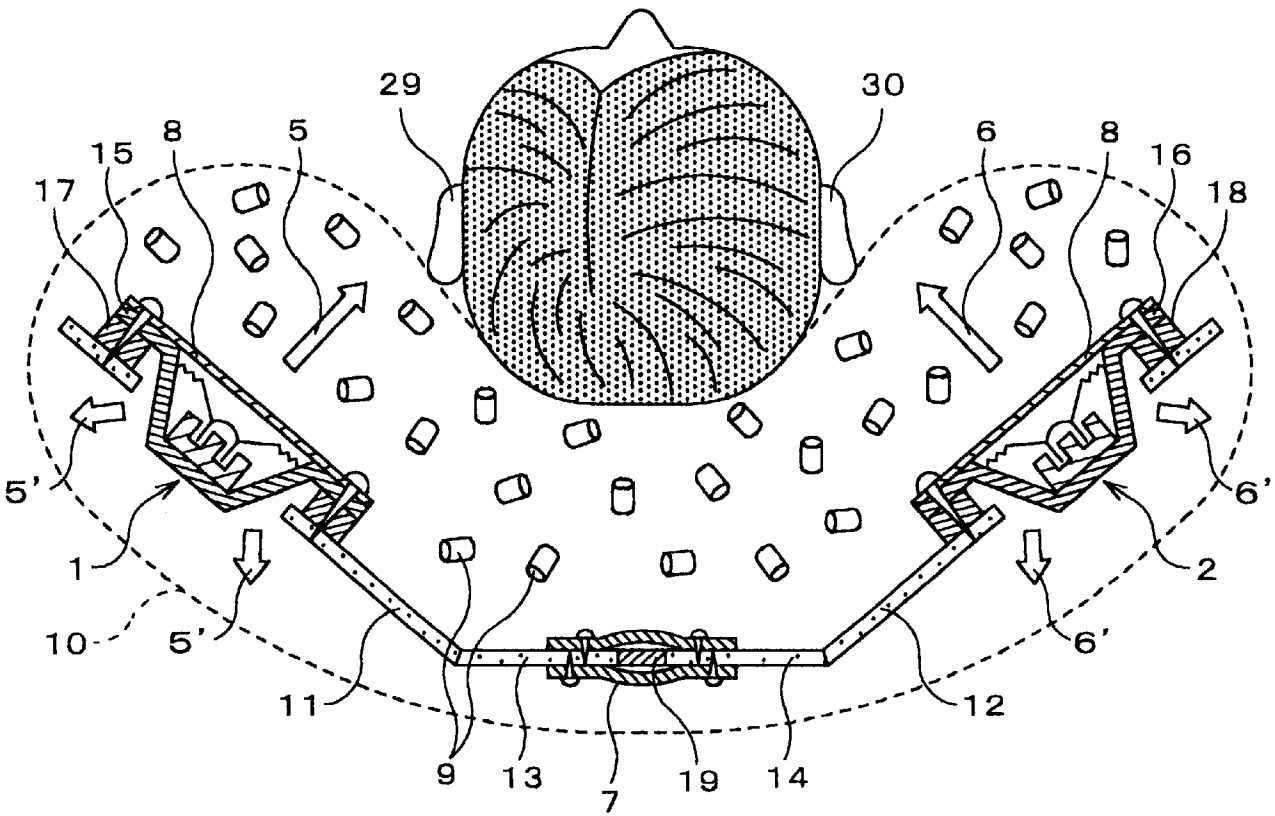
FIG. 6 is a cross-sectional view showing an embodiment of a structure around a speaker unit according to the present invention applied to a pillow, being apiece of bedding, in which the "basic" structure shown in FIG. 1 is used and a baffle board is utilized as a back sound screening board.

FIG. 6 is a cross-sectional view showing an embodiment of a structure around a speaker unit according to the present invention applied to a pillow, being a piece of bedding, in which the "basic" structure shown in FIG. 1 is used and a baffle board is utilized as a back sound screening board.

An L-channel dedicated first baffle board 11 with a speaker unit 1 for outputting L-channel sounds on it and an R-channel dedicated second baffle board 12 with a speaker unit 2 for outputting R-channel sounds on it are joined to a first backboard 13 and a second backboard 14 at their edges respectively so that these baffle boards face a listener's ears at a proper angle and distance. These L- and R-channel sounds produce a stereophonic effect. In this case, the L- and R-channel components form a unitary structure.

The first backboard 13 and the second backboard 14 may be regarded as extensions to the first baffle board 11 and the second baffle board 12 respectively.

A frame 15 of the speaker unit 1 and the first baffle board 11 are joined with a vibration absorbing member 17 of urethane foam (sponge) between. A frame 16 of the speaker unit 2 and the second baffle board 12 are joined with a vibration absorbing member 18 of urethane foam (sponge) between. The first backboard 13 and the second backboard 14 are joined with a vibration absorbing member 19 of urethane foam (sponge) between.

An elastic joining member 7 of chloroethylene is attached to a joint formed by the first backboard 13 and the second backboard 14 with moderate elasticity maintained in order to strengthen the joint.

Wrapping a pillow material (referring to a cushion material only) 9 and a bag 10 described later about this unitary structure forms the whole stereo speaker.

With a speaker shown in FIG. 6, L-channel sound waves 5 and 5' with phases opposite to each other are radiated from the L-channel dedicated speaker unit 1 in the forward and backward directions respectively. In this case, the sound wave 5 in front of the baffle board 11 is isolated to some extent from the sound wave 5' behind the baffle board 11 by the baffle board 11, so these sound waves will not cancel out each other by addition.

The area of the first baffle board 11 is finite and some of the sound wave 5' will travel to the front of the first baffle board 11 around its edge. However, the pillow material 9 functions as a sound absorbing material and absorbs the sound wave 5' which travels to the front of the first baffle board 11. As a result, most of the sound wave 5' will be absorbed before it can reach an ear 29. That is to say, the sound wave 5' almost never interferes with the sound wave 5. Therefore, low-pitched sounds included in the sound wave 5 almost never attenuate.

In this case, the above first operating principle, "the action of isolating the sound wave 5' with a phase opposite to that of the sound wave 5 generated behind the cone paper 27 from the sound wave 5," has much effect.

The distance between the L-channel dedicated speaker unit 1 and the ear 29 is short, so the sound wave 5, being direct sounds, almost never attenuates. As a result, the original sound will be reproduced with high fidelity.

Furthermore, the type of the pillow material 9 described later has a great influence on effect as a direct sound transmitting section and valid direct sounds almost never attenuate.

The same applies to the speaker unit 2. The pillow material 9 functions as a sound absorbing material and absorbs a sound wave 6' which travels to the front of the second baffle board 12 around its edge. That is to say, the sound wave 6' almost never interferes with a sound wave 6. As a result, low-pitched sounds included in the sound wave 6, being direct sounds, almost never attenuate.

The first baffle board 11 and the second baffle board 12 are far smaller and lighter than one used in the above conventional speaker. Therefore, if vibrations are transmitted from the speaker unit 1 to the first baffle board 11 via the frame 15 and from the speaker unit 2 to the second baffle board 12 via the frame 16, they may have the bad influence of mutual interference on the first baffle board 11 and the second baffle board 12. The vibration absorbing members 17, 18, and 19 and the elastic joining member 7 prevent these vibrations from being transmitted. As a result, sound waves which will ruin a stereophonic effect are screened out by these members.

The vibration absorbing members 17, 18, and 19 and the elastic joining member 7 absorb sound waves at audio frequencies. Furthermore, the vibration absorbing member 17 connects the frame 15 and the first baffle board 11 so that they become stable. Similarly, the vibration absorbing member 18 connects the frame 16 and the second baffle board 12 so that they become stable. The vibration absorbing member 19 and the elastic joining member 7 connect the first backboard 13 and the second backboard 14 so that they become stable.

If the pillow material 9 is, for example, buckwheat chaff, then a mesh protective net 8 is located in front of and behind the speaker units 1 and 2 (mesh protective nets located behind them are not shown) so that buckwheat chaff does not get into the speaker units 1 and 2.

In this embodiment, by using short tubes of hard resin, being almost equal in size to the tip of a little finger, sold at ordinary bedding stores, the desired sound effects and relaxed feeling were obtained. This tube is far larger and more air-permeable than buckwheat chaff.

Air-permeable cloth which does not screen out sound waves is suitable for the outside member (outside bag) 10 of a pillow.

Means for fixing, for the purpose of preventing the above buckwheat chaff or resin tubes from being unevenly distributed within the outside member (outside bag) 10, mesh inside bags (not shown) each containing part of the buckwheat chaff or resin tubes to important positions on, for example, the above baffle boards, means for protecting weak portions, such as the speaker units 1 and 2 and electric wires, which need a predetermined protection, and means for covering the hard corners of the above baffle boards etc. to secure a user's safety can be easily imagined by those skilled in the art and belong to the design category. Descriptions of them therefore will be omitted.

FIG. 7A shows a back sound screening board, in which a bag sealing liquid or gel is provided with constrictions and an irregular surface is formed by a recess-shaped or wave-shaped unevenness due to the constrictions, and it can be applicable as a baffle board 11 shown in the other figures. When using as the baffle board 11, the mounting structure of the speaker unit have to be slightly modified, however, details thereof will be omitted.

Figure 7B:
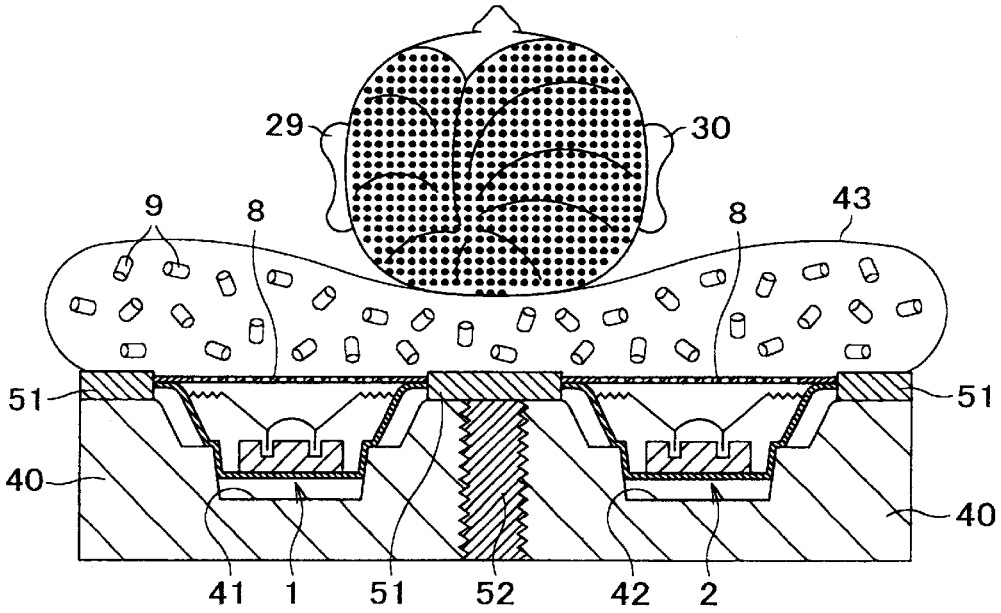
FIG. 7B is a cross-sectional view showing an embodiment of a structure around a speaker unit according to the present invention applied to a pillow, being a piece of bedding, in which the "embedded-type" structure shown in FIG. 2 is used and a sound absorbing material being able to maintain its shape is also utilized as material for a pillow.

FIG. 7B is a cross-sectional view showing an embodiment of a structure around a speaker unit according to the present invention applied to a pillow, being a piece of bedding, in which the "embedded-type" structure shown in FIG. 2 is used and a sound absorbing material being able to maintain its shape is also utilized as material for a pillow.

With a pillow shown in FIG. 6, importance is attached to sound reproduction. On the other hand, with a pillow shown in FIG. 7, importance is attached to its original function as a pillow. In addition to this, a function as a speaker which produces clear sounds is introduced. Therefore, angular members, such as a baffle board, are removed and speaker units are supported and housed only by a cushion member.

Conic cavities 41 and 42 are formed on the top of a member 40 of fibers having great elasticity and air-permeability, being a base for a pillow. An L-channel dedicated speaker unit 1 and an R-channel dedicated speaker unit 2 are fitted upward into the cavities 41 and 42 respectively. The speaker units 1 and 2 are covered with a protective net 8 in order to protect cone papers in them. The protective net 8 is completely covered with a pillow material 9.

A back sound screening board 51 consisting of a rubber mat with a thickness of about 3 millimeters is laid instead of a baffle board in order to obtain the effect of screening out back sounds.

An LR partition wall 52 is formed by injecting a waterproof resin (it is preferable to use a waterproof material) into the central portion of the member 40. Usually this waterproof resin is injected into target places with a dedicated injector when waterproofing work is done on a bathroom, a kitchen, or the like. With a silicone resin, for example, an elastic partition wall will be formed. This improves the effect of separating the L-channel and the R-channel and heightens stereo sound effects according to the present invention.

As a result of various experiments on material for the member 40, "Curllock (registered trademark of the Takagi Chemistry Laboratory)," being a cushion material regenerated from plastic bottles, gave good results.

Short tubes of hard resin, that is to say, hard resin tubes of a high molecular compound, such as polypropylene, with an outside diameter of 8 millimeters, a thickness of 1 millimeter, and a length of 10 millimeters which are not crushed between finger and thumb are suitable for the pillow material 9. They are suitable for a pillow itself and clear sounds can be obtained by the use of them. They are sold at a bedding store.

The pillow material 9 is dispersed within a pillow and each of mesh bags properly divided contains part of it.

The above hard resin tubes used in the above direct sound transmitting section are considered from their shape to form a cushion material which is hard to attenuate at least direct sounds. Therefore, if material other than the above hard resin tubes, such as sponge or cottonlike material, is used as a cushion material, necessary direct sounds will attenuate. The above buckwheat chaff, too, did not give good results.

Indirect sounds with a phase opposite to that of direct sounds generated behind the cone paper 27 can be considered from the shape of material used in the back sound screening section to cancel out each other while they repeat irregular reflection within Curllock described above. By considering so, its fine sound effects can be explained.

Therefore, even if space in front of the cone paper 27 is not separated from space behind the cone paper 27 by a hard board corresponding to the baffle board 11 shown in FIG. 2, the same effect will be obtained on the basis of the above first operating principle.

As stated above, the short tubes of hard resin produce the best sound effects, so they must be located directly over and near the protective net 8. Comfortableness, design, costs, and the like only as a pillow are thoroughly pursued for the other portions and the pillow material 9 is arranged in the best way.

To be concrete, the pillow material 9 can be arranged freely on the basis of the dividing shape (not shown) of the above mesh bags. For example, short tubes of soft polyethylene can be added only to the portion where the nape of a user touches to raise its height. This will heighten the added value of the goods and provide the advantage of product differentiation, resulting in a larger sale.

The technical thought of absorbing and screening out the above harmful sound waves which interfere with direct sounds and integrating all into one stable structure without distorting sound is the spirit itself of the invention applied to a pillow. To realize this technical thought, the following requirements must be met:

(1) The location is near a user's ears. In this embodiment, a speaker is housed in a pillow or the like.

(2) The structure and size are determined so that indirect sounds are screened out and only direct sounds reach the ears of a user of the pillow or the like.

(3) Material for the pillow or the like is also used as a sound absorbing material. Furthermore, a vibration absorbing member is used in the prime portion which supports and houses a speaker unit or in a base.

(4) The vibration absorbing member has flexibility for absorbing and screening out the above harmful indirect waves which interfere with direct sounds, maintains air-permeability and elasticity suitable for the pillow or the like, and forms a stable structure which does not distort sound.

Original ideas and devices, such as using a built-in amplifier, can be easily imagined by those skilled in the art. Therefore, any embodiment using an original idea or device covered by the above spirit and requirements of the invention applied to a pillow can be regarded as falling within the scope of the present invention.

Now, embodiments of the present invention in which stress is put primarily on a back sound screening board will be described with reference to FIGS. 8 through 10.

Figure 8:
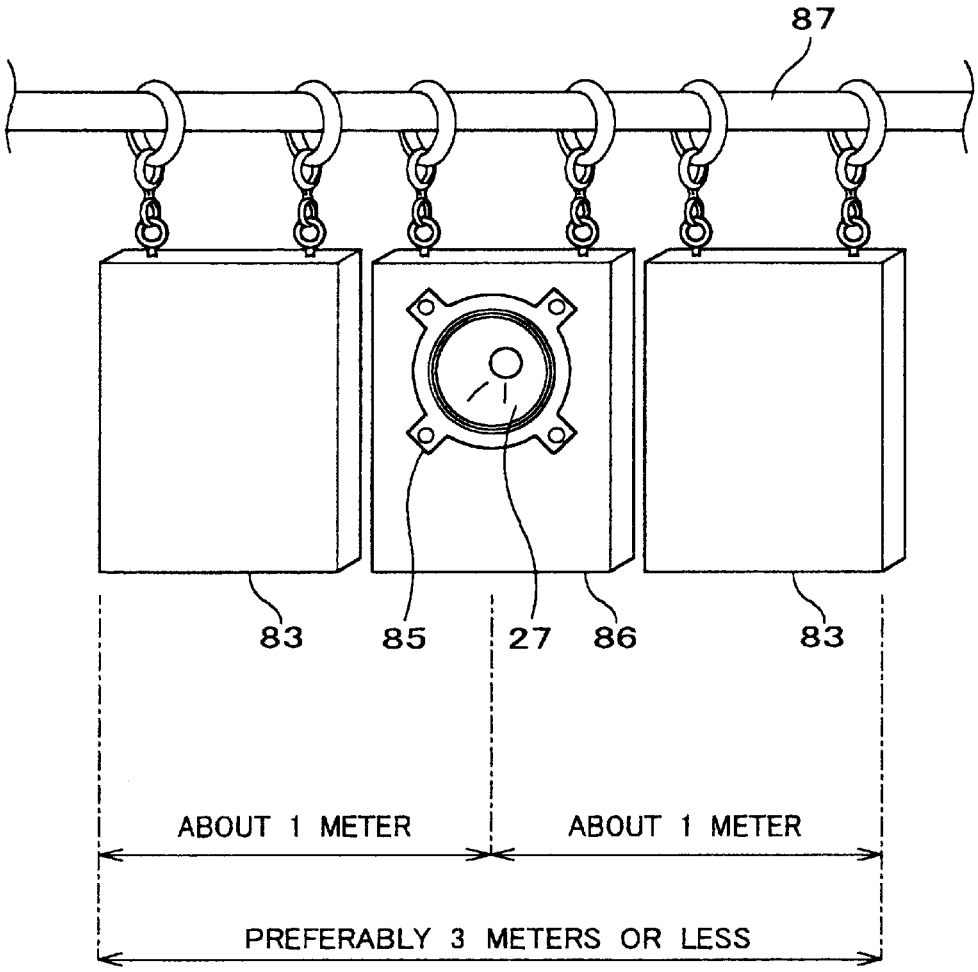
FIG. 8 shows an embodiment of a hanging back sound screening board according to the present invention.

FIG. 8 shows an embodiment of a hanging back sound screening board according to the present invention. In this embodiment, a hanging back sound screening board 83 is applied to a speaker including a baffle board 86 hanging from a pole 87. A frame 85 holds the edge of a cone paper 27 of the speaker so that the cone paper 27 can vibrate freely in the forward and backward directions. The frame 85 is also held to the baffle board 86 so that it can vibrate freely in the forward and backward directions.

The back sound screening board 83 is located at both sides of the cone paper 27 and the baffle board 86 nearly on a plane extending from them so that space in front of them is isolated from space behind them.

The baffle board 86 also functions as a back sound screening board, but it is not called a back sound screening board for convenience of an explanation for FIG. 8.

In this case, the "back sound screening board" can be considered as an "acoustic resonance reflecting board," because it also functions as "passive radiator," that is to say, as a sound source. This is one of the two basic principles of the present invention, so this applies to all the embodiments shown in FIGS. 1 through 10.

The cone paper 27 of a speaker has an "active radiation function," while the back sound screening board has "the function of radiating passive resonances set up by the cone paper 27 in cooperation with the cone paper 27." This is why the back sound screening board can be considered as an acoustic resonance reflecting board.

Moreover, the back sound screening board (hereinafter also referred to as a "passive radiator" or "acoustic resonance reflecting board") 83 is faced almost squarely to a listener. That is to say, even if the back sound screening board 83 is a speaker itself, the listener can listen to sound which comes directly from the back sound screening board 83.

Tests for checking the effect of the back sound screening board 83 showed that the existence of the back sound screening board 83 clearly turns up sound volume to a listener.

In addition, when the back sound screening boards 83 of a foamed chloroethylene board the size of the baffle board 86 (about 60 centimeters in width) with a thickness of about 4 millimeters were located at both sides of the baffle board 86 at the same short distance from the baffle board 86, the best sound effects were obtained.

As shown in FIG. 8, the distance between the cone paper 27 located in the middle of the baffle board 86 and the far end of one back sound screening board 83 is 1 meter or less and the total width is 2 meters or less. When the total width exceeded 3 meters, good results were not obtained. Therefore, it is preferable that the total width should be 3 meters or less.

Most types of rigid boards will have the same effect as the baffle board 86, but corrugated cardboard has no effect.

To obtain a good stereophonic effect, it is preferable that the relative positions of the L-channel dedicated speaker, the R-channel dedicated speaker, and a listener should form a regular triangle. Sufficient space between the L-channel dedicated speaker and the R-channel dedicated speaker is ideal for a good stereophonic effect.

The reflection function of the back sound screening board (acoustic resonance reflecting board) 83 described above will be the same as the effect of a reflecting board used in an electric illuminator. That is to say, as a search light or headlight cannot be made without a reflecting board, the force of a limited energy source is delivered efficiently to a target.

It is assumed that energy continues to be radiated from a sound or light source. In this case, if it is not concentrated on a target with a lens or reflecting board, it diffuses in almost all directions and falls off at the inverse square of the distance.

No one doubts the effect of the above reflecting board as a physical phenomenon, but, practically, it has almost never been applied to acoustic equipment. Among others, it has almost never been applied to a stereo speaker for reproducing sound with high fidelity disclosed in the present invention.

The reason for this is that the fixed idea of a conventional stereo speaker with a resonance box has taken root not only among acoustic engineers but also among the public. It is the common sense, "a speaker displays its original performance only when it is housed in a resonance box."

The majority of the persons concerned, such as makers, users, and broadcasters, believe it because the use of a resonance box was approved publicly as actual results.

Only the sensitive use of reflected sound was noticed with respect to acoustic design for theaters and concert halls. However, this was limited to, for example, studies on the reason why delay time for reverberations produces interesting sounds to the ear.

It can be easily understood in principle that the back sound screening board 83 delivers sound waves efficiently to a listener who is directly in front of a speaker, being a sound source. In practice, however, this has almost never been studied. Therefore, an embodiment which gave the best results will now be shown.

In this embodiment, the fidelity and loudness of sound reproduced by a small-sized low-output speaker are equal to those of sound reproduced by a large-sized high-output speaker. Therefore, a speaker with the same performance as a conventional one can be priced down, of course.

High-fidelity reproduced sounds which were obtained by a conventional stereo speaker with a resonance box and a high-output amplifier at an expense of 500,000 yen can be realized by a simple small-sized low-output speaker at an expense of only tens of thousands of yen.

Moreover, an efficient acoustic apparatus being able to minimize the attenuation of sound even in a listening room the sound absorbing structure of which is not desirable in terms of sound effects can be provided. An example of such a room is a Japanese-style room (not shown) with a closet for housing futons.

The relative positions of the cone paper 27 and the back sound screening board 83 are maintained without the frame 85 of the speaker touching the baffle board 86 or by connecting the frame 85 and the baffle board 86 flexibly (not shown). That is to say, each portion hangs from the pole 87.

This means for connecting the frame 85 and the baffle board 86 flexibly is the same as those shown in FIGS. 1 through 5. The effect of the back sound screening board 83 according to the present invention can be maximized by the use of this means.

This enables to remove a massive resonance box and to reproduce sound with high fidelity. Therefore, a speaker with the same performance as a conventional one can be priced down.

In addition, particular resonance frequencies are not exalted unnaturally. That is to say, reproduced sounds are agreeable to the ear.

Figure 9:
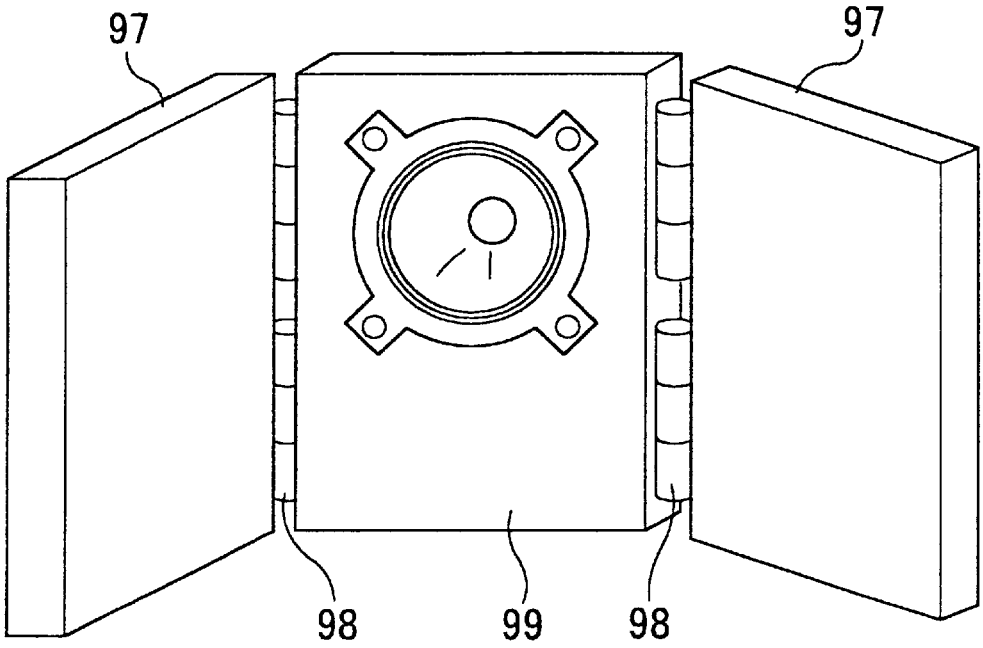
FIG. 9 shows an embodiment of a back sound screening board of a folding screen type according to the present invention.

FIG. 9 shows an embodiment of a back sound screening board of a folding screen type according to the present invention.

A back sound screening board 97 shown in FIG. 9 is located at both sides of a baffle board 99 and is supported with the baffle board 99 by the use of an oilless resin hinge 98 so that the back sound screening board 97 can be freely folded like a flap.

When the back sound screening boards 97 of a foamed chloroethylene board the size of the baffle board 99 with a thickness of about 4 millimeters were located at both sides of the baffle board 99 at the same obtuse angle to the baffle board 99, the best sound effects were obtained. In a word, the back sound screening boards 97 should be located at right angles to a listener.

The total width is the same with the embodiment shown in FIG. 8.

As shown in FIGS. 8 and 9, restrictions on the size of a room where a speaker is located, fittings inside it, and speaker design can be reduced by adopting the entire structure of an approximately vertical flat board. This structure is not bulky, so a speaker can be moved or housed easily.

Moreover, the entire structure of an approximately flat board will result in a larger sale by executing a completely novel design on it and enable a user to attach wallpaper, posters, or the like to it.

Furthermore, all the cathode-ray tubes used in televisions may be replaced by flat liquid crystal panels in the near future. In that case, the standard for designs for audio and video (AV) equipment will probably be changed from a box type to a vertical flat board type.

In addition, the housing situation in Japan is bad now. AV equipment should basically form comfortable living space, but in reality there are many cases where AV equipment limits human living space. In order to solve such a situation, it is urgent that the present invention should be applied. That is to say, graceful AV equipment of the vertical flat board type design used in the near future should be manufactured as goods and be spread.

For example, a "dedicated software replay equipment for producing a synergistic effect between images and stereophony" sold under the name of "AV Surround," "Home Theater," or the like is attracting many people's interest now, but it is not very widespread. If speaker systems of the vertical flat board type design and low-cost AV equipment are adopted, the spread of the dedicated software replay equipment will be promoted. This contributes toward the development of the AV-related equipment and software industries in cooperation with the BS digital broadcasting started as commercial broadcasting and Internet delivery of television programs.

Figure 10:
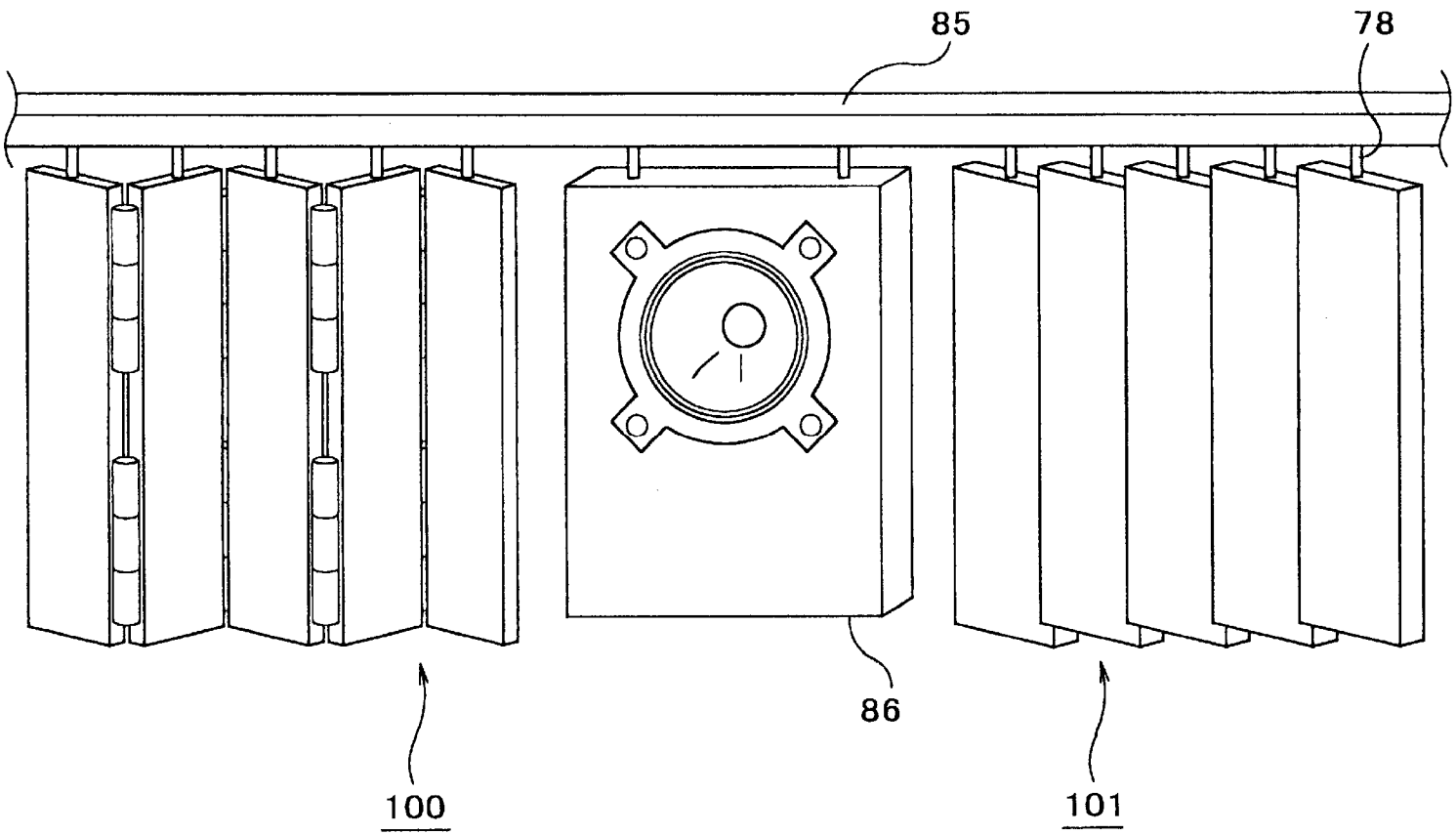
FIG. 10 shows an embodiment of a foldable back sound screening board of an "accordion curtain type" or "slide shutter type" according to the present invention.
Figure 11:
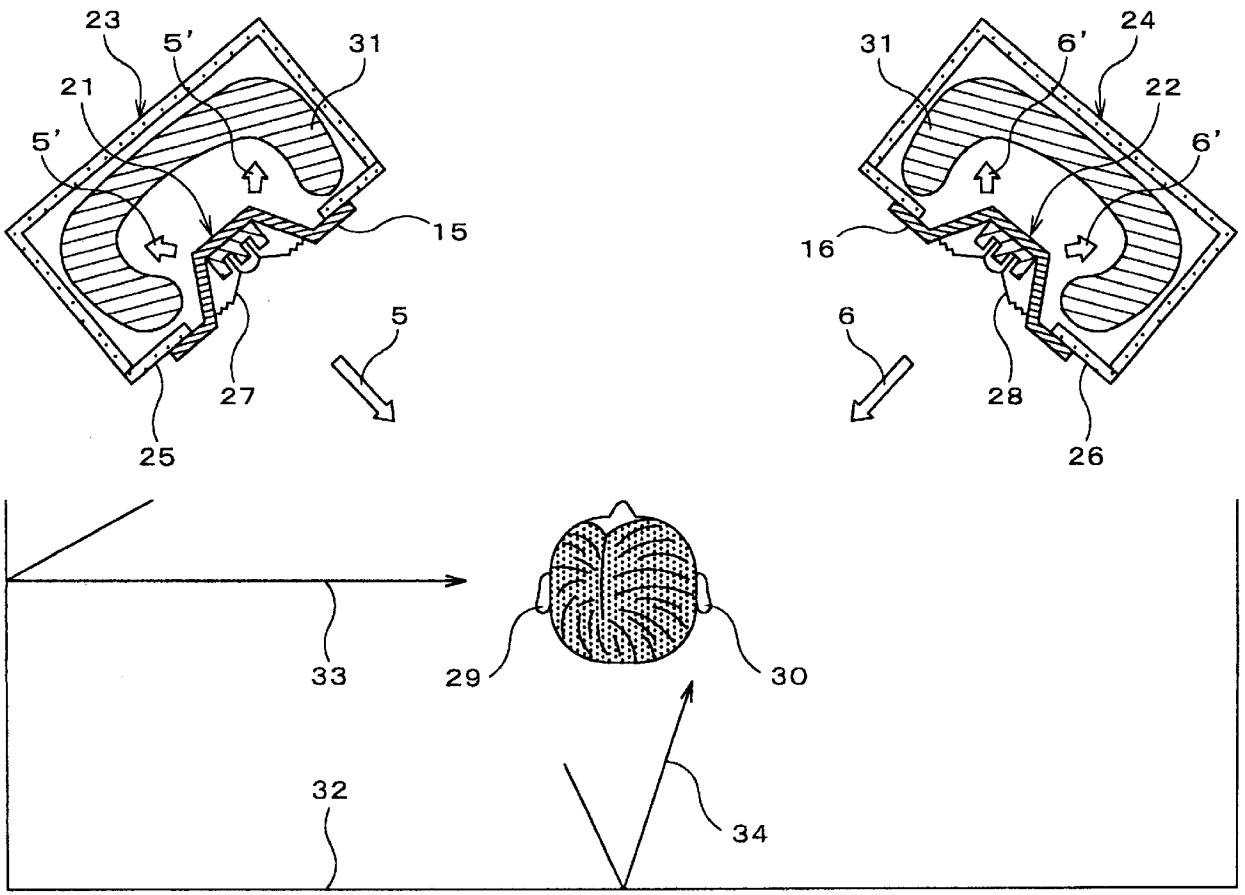
FIG.11 PRIOR ART
FIG. 11 is a horizontal cross-sectional view of a conventional household stereo speaker.
Figure 12:
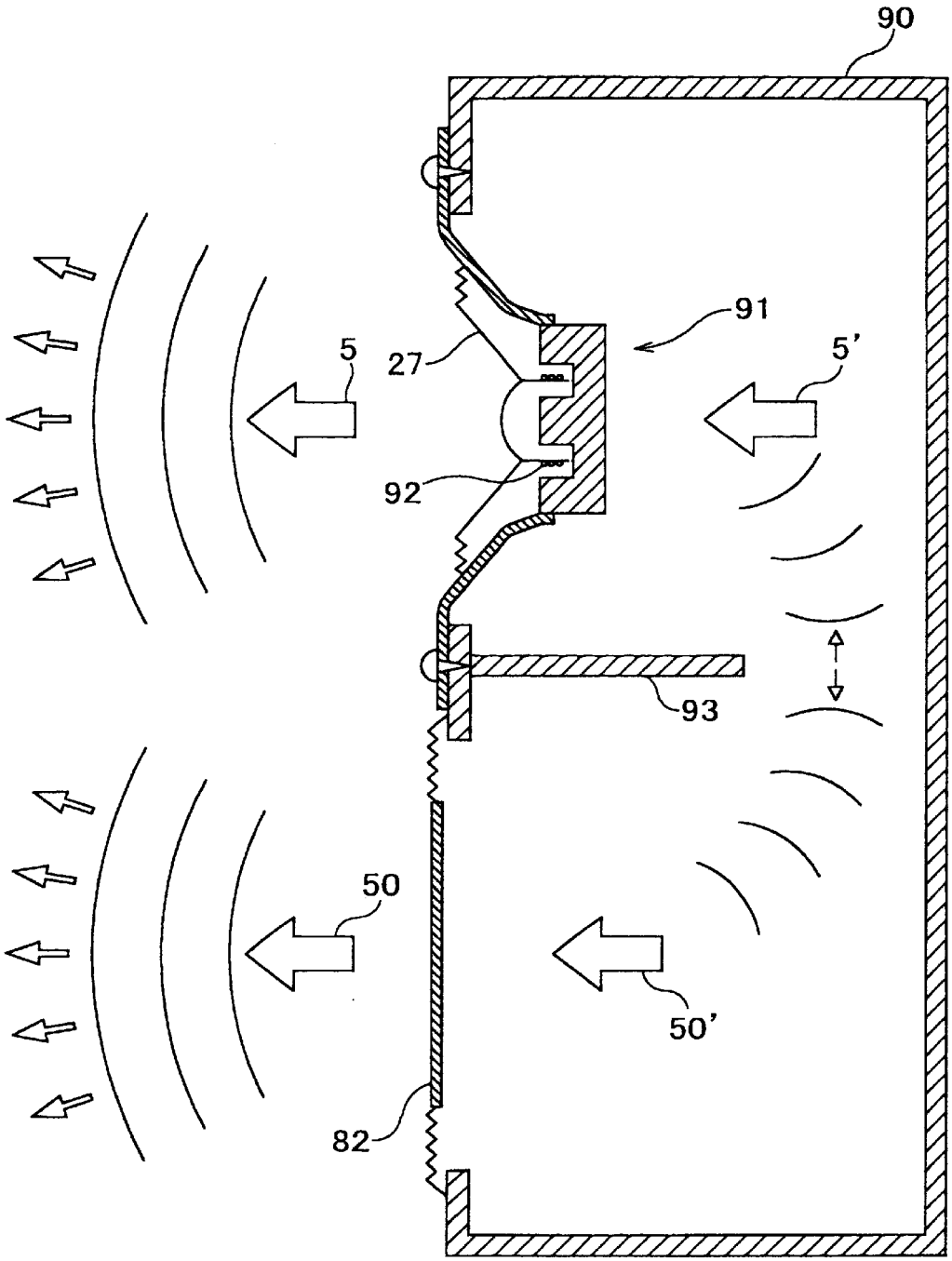
FIG.12 PRIOR ART
FIG. 12 is a longitudinal cross-sectional view of a conventional passive radiator.

FIG. 10 shows an embodiment of a foldable back sound screening board of an "accordion curtain type" or "slide shutter type" according to the present invention.

In FIG. 10, a lightweight back sound screening board being foldable like an accordion curtain (hereinafter also referred to as the "accordion curtain") 100 consists of long and narrow resin boards with a thickness of between about 3 and 10 millimeters and a width of about 10 centimeters which are connected by hinges. The back sound screening board 100 is hung from a head jamb 85 by sliding metal fittings 78 so that the back sound screening board 100 can slide freely on a rail of the head jamb 85. The back sound screening board 100 is a fitting for partitioning a room which can be opened and closed freely.

The accordion curtain 100 is located with both sides (only the left-hand side in FIG. 10) of a baffle board 86 as doors so that it can be opened and closed freely. The area of the accordion curtain 100 and the relative positions of the accordion curtain 100 and the baffle board 86 should be optimized with fittings inside a room where the accordion curtain 100 is to be located taken into consideration. The accordion curtain 100 may be left open at need.

A back sound screening board 101 located on the right-hand side of the baffle board 86 shown in FIG. 10 which can be folded freely like a slide shutter (hereinafter also referred to as the "slide shutter") also consists of long and narrow boards with a thickness of between about 3 and 10 millimeters and a width of about 10 centimeters which are not connected by hinges. The back sound screening board 101 is hung from the head jamb 85 by the sliding metal fittings 78 so that the back sound screening board 101 can slide freely on the rail of the head jamb 85 and therefore expand and overlap freely like a blind which opens and closes horizontally. The back sound screening board 101 is a fitting for partitioning a room which can be opened and closed freely. The back sound screening board 101 may be left open at need. This is the same with the accordion curtain 100.

Therefore, by utilizing the original functions of the accordion curtain 100 and the slide shutter 101, any situation can be coped with.

Similarly, by using a sliding door, a door, or the like (not shown) as a back sound screening board which can be moved, opened, and closed freely, preferred embodiments should be obtained. A combination of such a back sound screening board and the baffle board 86 can be regarded as falling within the scope of the present invention.

Next, with reference to FIGS. 13 to 16, a first to fourth embodiments of the present invention by way of design drawings will be described. Since the effects of these embodiments are substantially the same as those of the embodiment shown in FIG. 2, most of the operative descriptions are omitted.

Figure 13A:
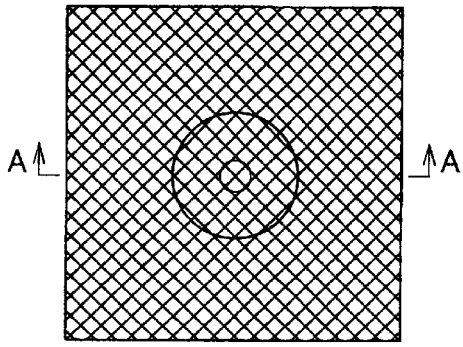
FIG. 13A is a front view.
Figure 13B:
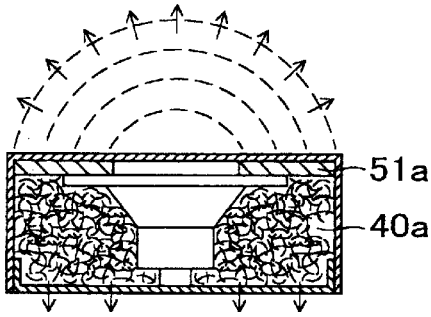
FIG. 13B is a sectional view taken along the line A—A of FIG. 13A.
Figure 13C:
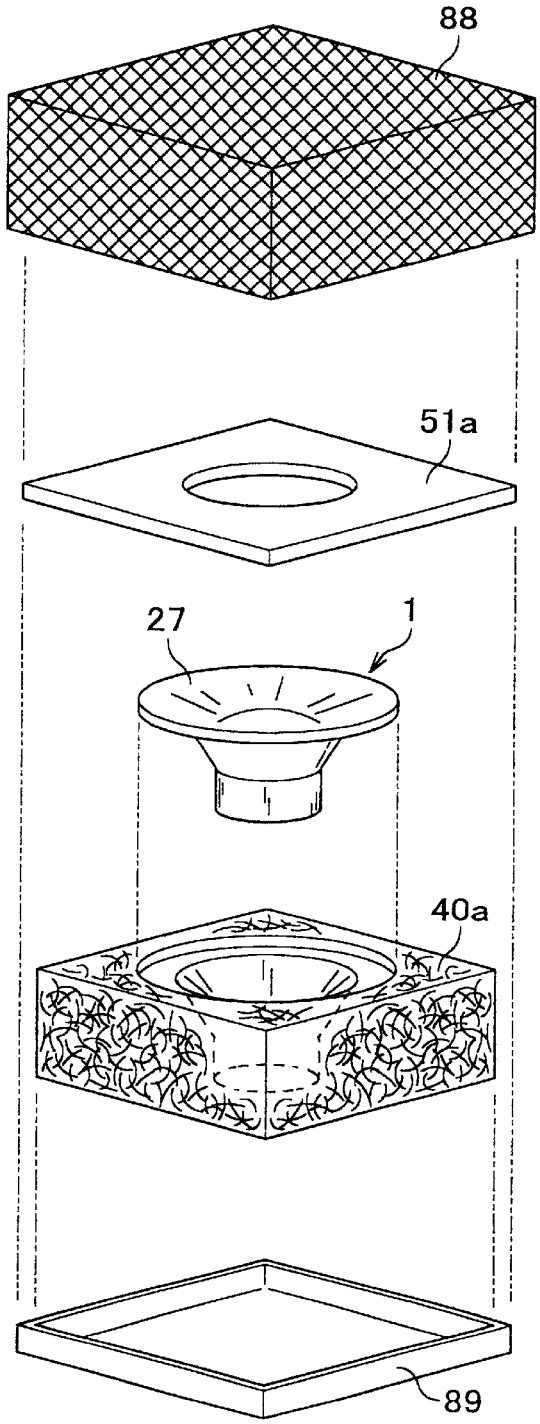
FIG. 13C is an exploded sectional view thereof.

FIG. 13 shows a first embodiment of the present invention by way of design drawing, in which FIG. 13A is a front view, FIG. 13B is a sectional view taken along the line A—A of FIG. 13A, and FIG. 13C is an exploded sectional view thereof. A punching board, decorative wire mesh, top grille (protection net with a frame) 88 or the like may have a function to keep the profile as well as protecting the cone paper 27.

Instead of the baffle board, the back sound screening board 51*a* made of a mat with a hole portion, which mainly consists of a bag sealing therein gel, is employed. FIG. 13 shows only one speaker unit 13, however, a plurality of units may be used for obtaining a stereo effect. Because the Curllock member 40*a* has a fiber structure with sufficient air permeability and elasticity and with proper rigidity, it can retain the compact speaker unit 1 to a certain position. The rear cover 89 may be made from the same material as that introduced with reference to FIG. 13C, and is made of a punching board, decorative wire mesh or the like, so as to keep a certain outer profile and to support the whole mounting structure. When mounting on a flat wall by directly contacting the wall, the rear cover 89 may be a cheap sheet metal or veneer plate, regardless of the air permeability of the rear cover 89.

Figure 14A:
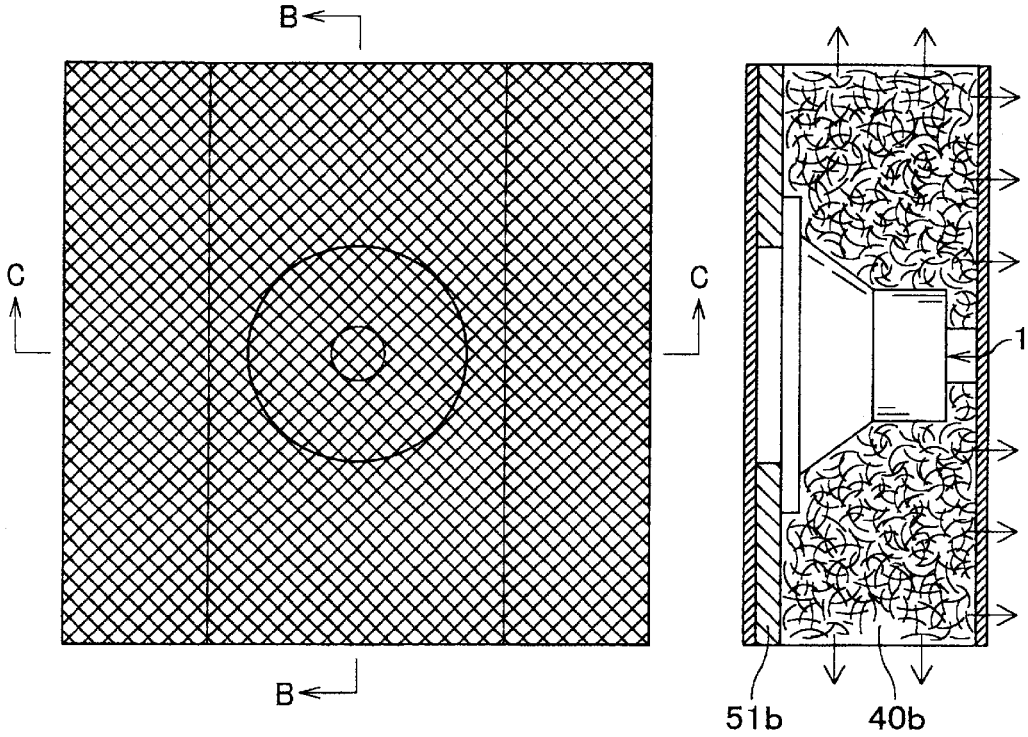
FIG. 14A shows a front view and a vertical sectional view taken along the line B—B.
Figure 14B:
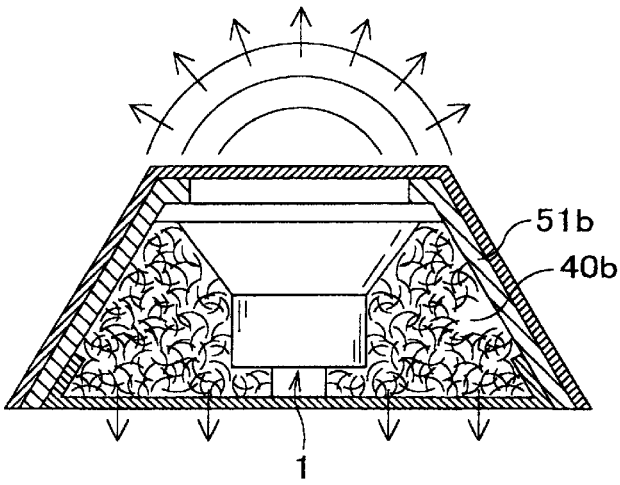
FIG. 14B is a transverse sectional view taken along the line C—C of FIG. 14A.

FIG. 14 shows a second embodiment of the present invention by way of design drawing, in which FIG. 14A shows a front view and a vertical sectional view taken along the line B—B, and FIG. 14B is a transverse sectional view taken along the line C—C of FIG. 14A. The Curllock member 40*b* has substantially trapezoidal section, and its front projection is covered, from the front part, with the back sound screening board 51*b* made by a mat with a hole portion mainly consisting gel.

Since it is obvious to one skilled in the art, a punching board, decorative wire mesh, top grille 88*a* or the like is omitted from FIG. 14A. The same can be said to FIGS. 15 and 16.

Herein, the back sound screening board 51*b* surrounds the front part of the speaker unit (as a sound source) with a trough-shaped curved surface, and the front and rear of the speaker unit 1 is effectively and separately shut out. Therefore, the object of the present invention can be achieved by an area smaller than the back sound screening board 51*a* formed by a flat plate, and pure and clear sound can be obtained by a small and compact structure.

Figure 15A:
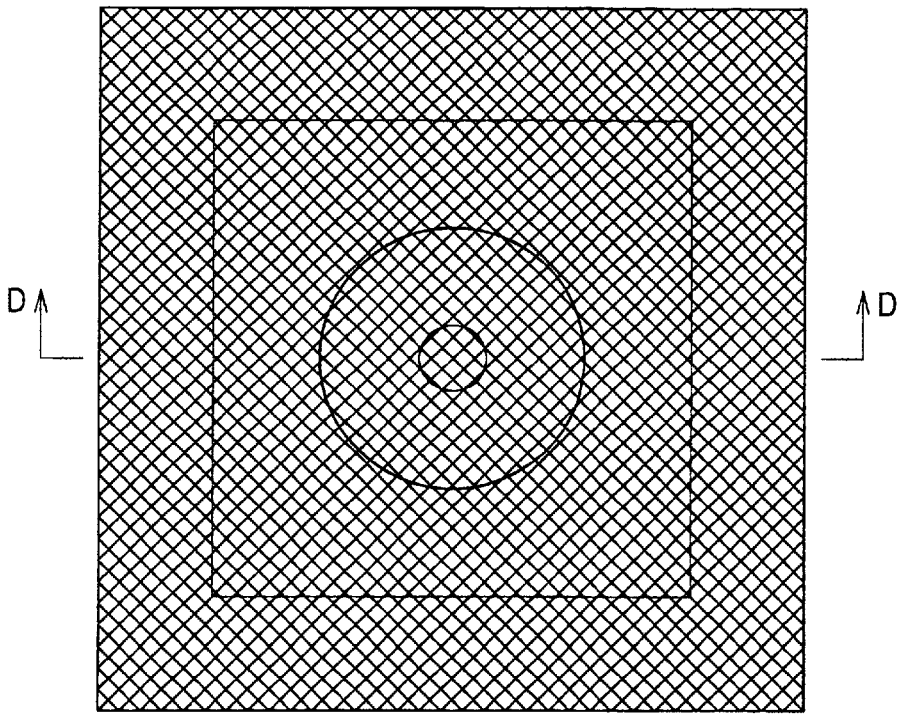
FIG. 15A is a front view.
Figure 15B:
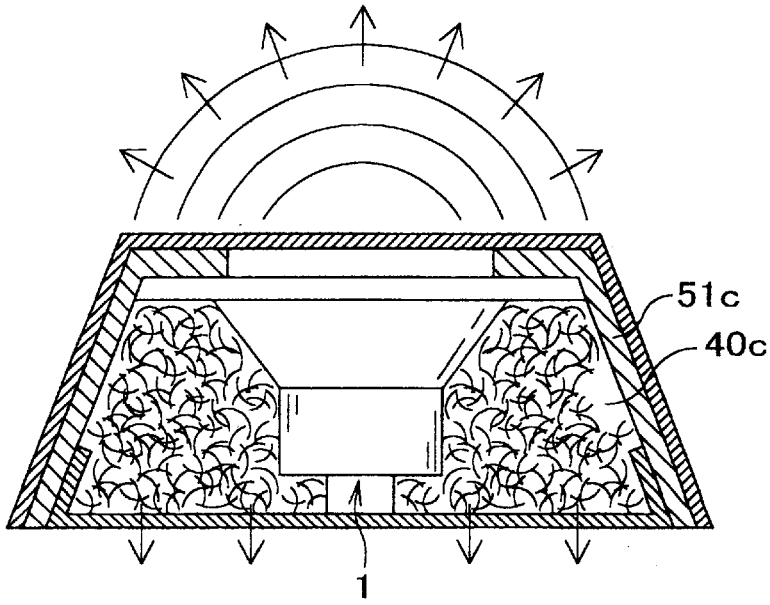
FIG. 15B is a sectional view taken along the line D—D of FIG. 15A.

FIG. 15 shows a third embodiment of the present invention by way of design drawing, in which FIG. 15A is a front view, and FIG. 15B is a sectional view taken along the line D—D of FIG. 15A.

The Curllock member 40*c* has substantially trapezoidal section, and the center portion of its top surface is provided with a conical hole for the insertion of the speaker unit 1.

Herein, the back sound screening board 51*c* has a trapezoidal shape, and the bottom surface thereof is provided with a circular hole so as to surround the speaker unit 1 from the front part.

Therefore, the front and rear of the speaker unit 1 is effectively and separately shut out by the back sound screening board 51*c*. Therefore, the object of the present invention can be achieved by an area smaller than the back sound screening board 51*a* formed by a flat plate, and pure and clear sound can be obtained by a small and compact structure.

Figure 16A:
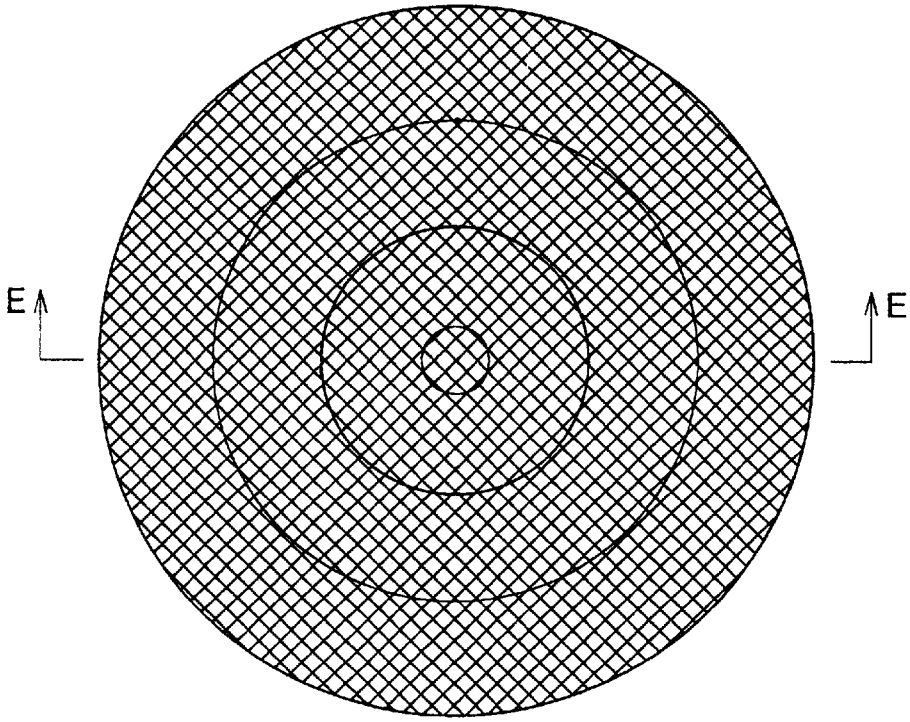
FIG. 16A is a front view.
Figure 16B:
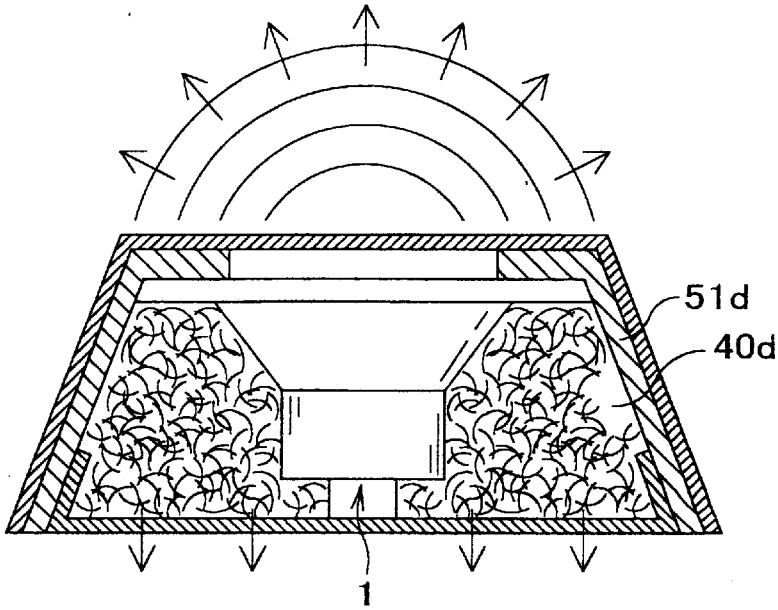
FIG. 16B is a sectional view taken along the line E—E of FIG. 16A.

FIG. 16 shows a fourth embodiment of the present invention by way of design drawing, in which FIG. 16A is a front view, and FIG. 16B is a sectional view taken along the line E—E of FIG. 16A.

The Curllock member 40*d* has substantially trapezoidal section, and the center portion of its top surface is provided with a conical hole for the insertion of the speaker unit 1.

Herein, the back sound screening board 51*d* has a trapezoidal shape, and the bottom surface thereof is provided with a circular hole so as to surround the speaker unit 1 from the front part.

Therefore, the front and rear of the speaker unit 1 is effectively and separately shut out by the back sound screening board 51*d*. Therefore, the object of the present invention can be achieved by an area smaller than the back sound screening board 51*a* formed by a flat plate, and pure and clear sound can be obtained by a small and compact structure.

The portions shown in all the drawings which have the same function or effect have been expressed by the same symbol in order to avoid duplication of explanation.

What is claimed is:

1. A pillow structure in combination with a speaker unit, the combination comprising:

a speaker unit comprising a frame supporting a magnet and a vibrating cone;

a baffle board including a sound transmitting hole portion;

a direct sound transmitting section for transmitting only direct sounds which come from the front of the speaker unit; and a back sound screening section for screening out indirect sounds which come from the back of the speaker unit and travel forward, wherein the frame of the speaker unit is mounted to the baffle board through a vibration absorbing member to isolate the speaker unit from the baffle board so that the frame of the speaker unit can move freely in the direction in which the vibrating cone vibrates with strokes being substantially the same as the amplitude of the vibrations of the vibrating cone; and said speaker unit being substantially enclosed by said pillow structure.

2. The combination according to claim 1, further comprising a fitting guide with a concave portion which is adapted to house the frame with room outside an edge of the frame around the hole portion made in the baffle board and the frame is located in the concave portion through the vibration absorbing member.

3. The combination according to claim 1, further comprising a fitting guide with a concave portion which is adapted to house the frame or an outer portion joined unitarily to the frame with room outside an edge of the frame or the outer portion, wherein the frame or the outer portion is located in the concave portion with the vibration absorbing member between.

4. The combination according to claim 3, wherein the fitting guide comprises another part separate from said baffle board.

5. A pillow structure in combination with a speaker assembly in which speaker units for outputting L-channel sound and R-channel sound independently produce a stereophonic effect are located substantially within said pillow so that the speaker units face a listener's left and right ears respectively when said users head is positioned proximate said pillow, the speaker assembly comprising:

an L-channel dedicated speaker unit comprising a first magnet and a first vibrating cone;

a first baffle board for holding the L-channel dedicated speaker unit flexibly with a first vibration absorbing member mounted between the first baffle board and the first vibrating cone;

an R-channel dedicated speaker unit comprising a second magnet and a second vibrating cone;

a second baffle board for holding the R-channel dedicated speaker unit flexibly with a second vibration absorbing member mounted between the second baffle board and the second vibrating cone; and a third vibrating absorbing member between and interconnecting the first baffle board and the second baffle board, a direct sound transmitting section for transmitting only direct sounds which come from the front of the speaker unit; and a back sound screening section for screening out indirect sounds which come from the back of the speaker unit and travel forward, wherein the first baffle board and the second baffle board are joined flexibly.

6. The combination according to claim 5 wherein;

said pillow structure encloses said L-channel and R-channel dedicated speaker units; said first and second baffle boards; and said first, second and third vibration absorbing members; and a cushion material which serves not only as a cushion material for the pillow but also as the direct sound transmitting section and the back sound screening section.

7. The combination to claim 1, wherein the direct sound transmitting section and the back sound screening section include short tubes of hard resin with a thickness of between 0.5 and 1.5 millimeters, an outside diameter of between 5 and 15 millimeters, and a length of between 5 and 20 millimeters.

8. The combination to claim 7, the structure further comprising:

a base in which at least one cavity for housing said speaker unit is formed on the top of said vibration absorbing member having air-permeability and elasticity;

sound emitting surfaces of the speaker unit faced outward;

protective members for protecting the sound emitting surfaces of the speaker unit; and a cushion material for said pillow structure comprising the short tubes of hard resin which covers the sound emitting surfaces.

9. The combination to claim 1, the combination further comprising back sound screening boards which are located nearly on a plane extending from the edge of a vibrating board of a speaker so that space in front of the vibrating board is isolated from space behind the vibrating board and which are faced at almost right angles to a listener.

10. The combination to claim 9, wherein the back sound screening boards have a mechanism in which the relative positions are maintained without touching a speaker frame or by connecting with a speaker frame flexibly.

11. The combination to claim 10, wherein the back sound screening boards are freely foldable.

12. The combination to claim 11, wherein the back sound screening boards are made of a foamed chloroethylene board, a wooden board, or a veneer board, have thickness of between 1 and 10 millimeters, and have a maximum expanded external size of 3 meters or less from the center of a speaker unit.

13. The combination to claim 12, wherein a mat with a hole portion is further provided as the back sound screening section and comprises a bag sealing therein liquid or gel, and wherein the surface of said vibrating cone is ventilated through the hole portion.

14. The combination to claim 13, wherein a shape and a mounting position of the mat is the same as those of the baffle board.

15. The combination to claim 14, wherein the vibration absorbing member is mainly constructed by the bag sealing therein liquid or gel and is positioned between said baffle board and said frame.

16. The combination to claim 15, wherein said frame is located in the concave portion through the vibration absorbing member comprised of the bag sealing therein liquid or gel.

17. The combination to claim 16, wherein constrictions are made on the bag sealing therein liquid or gel, and an irregular surface is formed by a recess-shaped or wave-shaped unevenness due to the constrictions.

18. The combination to claim 17, wherein said bag mainly consists of silicone rubber.

19. The combination to claim 18, wherein said gel has a stiffness and elasticity barely retaining its shape at room temperatures, and the bag is mainly formed by silicone rubber in the thickness of between 0.05 to 1 millimeter.

20. The combination to claim 19, wherein said gel is mainly formed by a high water absorbability polymer consisting acrylamide cross-linking structure.

* * * * *